US005337114A

United States Patent [19]

Mogi

[11] Patent Number: 5,337,114

[45] Date of Patent: Aug. 9, 1994

[54] METHOD AND APPARATUS FOR ADDING WATER TO PHOTOSENSITIVE MATERIAL PROCESSOR

[75] Inventor: Fumio Mogi, Kanagawa, Japan

[73] Assignee: Fuji Photo Film Co., Ltd., Kanagawa, Japan

[21] Appl. No.: 991,747

[22] Filed: Dec. 17, 1992

[30] Foreign Application Priority Data

Dec. 27, 1991 [JP] Japan ..... 3-346701

[51] Int. Cl.[5] ..... G03D 3/02

[52] U.S. Cl. ..... 354/324

[58] Field of Search ..... 354/319-324; 134/64 P, 64 R, 122 P, 122 R

[56] References Cited

U.S. PATENT DOCUMENTS 5,177,521 1/1993 Mogi et al. ..... 354/298
5,185,623 2/1993 Mogi ..... 354/299

FOREIGN PATENT DOCUMENTS 1254959 10/1989 Japan .
1254960 10/1989 Japan .
1281446 11/1989 Japan .
2103894 4/1990 Japan .

OTHER PUBLICATIONS

Japanese Patent Abstracts, vol. 91, p. 999 (JPA 1-281446).
Japanese Patent Abstracts, vol. 158, p. 985 (JPA 1-254959).
Japanese Patent Abstracts, vol. 159, p. 985 (JPA 1-254960).
Japanese Patent Abstracts, vol. 132, p. 1335 (JPA 4-1756).

*Primary Examiner*—D. Rutledge
*Attorney, Agent, or Firm*—Sughrue, Mion, Zinn, Macpeak & Seas

[57] ABSTRACT

A method and an apparatus for adding water to a photosensitive material processor for adding an amount of water corresponding to an amount of evaporation of a processing solution stored in a processing tank of the photosensitive material processor, to the processing tank, so as to keep the concentration of the processing solution constant. Relationships between an ambient condition which is determined by one of an ambient temperature and relative humidity of the photosensitive material processor, an ambient vapor pressure, and an ambient absolute humidity on the one hand, and the amount of evaporation of the processing solution on the other, are determined in advance. The ambient condition is detected, and the amount of water to be added to the processing tank is determined on the basis of the ambient condition detected and the relationships determined, so as to supply the determined amount of water to the processing tank.

23 Claims, 13 Drawing Sheets

10
TO TRANSPORTING SYSTEM
78
80
92
86
ROM
88
82
CPU
84
RAM
90
INPUT/OUTPUT PORTS
DRIVER
94
DRIVER
96
36
34
32
35
33
56
76
F
58
70
60
67
68
66
64
62
(12)
(14)
(16)
$V_D$
(18)
(22)
(24)
(26)
(DEVELOPMENT)
(BLEACHING)
(BLEACHING/FIXATION)
(FIXATION)
(WASHING)
(WASHING)
(STABILIZATION)
50
TEMPERATURE SENSOR
52
HUMIDITY SENSOR

10
TO TRANSPORTING SYSTEM
78
80
92
86
ROM
88
82
CPU
84
RAM
90
INPUT/OUTPUT PORTS
DRIVER
94
DRIVER
96
50
TEMPERATURE SENSOR
52
HUMIDITY SENSOR
36
35
32
33
34
56
76
F
58
70
60
67
68
66
64
62
(12)
(14)
(16)
Vb
(18)
(22)
(24)
(26)
(WASHING)
(STABILIZATION)
(WASHING)
44
(FIXATION)
(BLEACHING/FIXATION)
(BLEACHING)
42
(DEVELOPMENT)
40

METHOD AND APPARATUS FOR ADDING WATER TO PHOTOSENSITIVE MATERIAL PROCESSOR

BACKGROUND OF THE INVENTION

1. Field of the Invention

The present invention relates to a method and an apparatus for adding water to a photosensitive material processor, and more particularly to a method and an apparatus for adding water to a photosensitive material processor to keep constant the concentrations of processing solutions stored in processing tanks.

2. Description of the Related Art

An automatic processor, i.e., a kind of photosensitive material processor, is provided with processing tanks such as a developing tank, a bleaching tank, a fixing tank, a washing tank, and a stabilizing tank. A developing solution, a bleaching solution, a fixing solution, washing water, and a stabilizing solution (hereafter, these solutions and water will be generally referred to as the processing solutions) are stored in the respective tanks. The photosensitive material subjected to print processing is consecutively immersed and processed in the processing solutions in the respective processing tanks, and is then dried in a drying station disposed downstream of a final processing tank and is taken out.

Since the replenishment of replenishers in the respective processing tanks is effected in correspondence with the amount of the photosensitive material processed and the like, the compositions of the processing solutions are kept constant. With respect to the loss of the processing solutions due to evaporation, however, only the water in the processing solutions decreases, so that the concentrations of the processing solutions change, thereby deteriorating the processing performance. For this reason, in order to maintain the original concentrations of the processing solutions, it is necessary to add water corresponding to the evaporated portions separately in addition to the replenishers. However, the amount of evaporation differs depending on the surrounding environment, i.e., the ambient temperature and humidity, and it also differs depending on whether the apparatus is running, is on standby, or is resting. Hence, it is impossible to univocally set the amount of evaporation through calculation and the like.

For this reason, there has been proposed a technique in which a level sensor such as a float is provided in each processing tank, and water is added on the basis of the detected value of each level sensor (for example, see Japanese Patent Application Laid-Open No. 281446/1989). With the level sensors, however, components of the processing solutions can be deposited and adhere to the floats, thereby possibly leading to erroneous detection of the solution level. Hence, the level sensors have low reliability, and there are cases where it is impossible to effect addition of appropriate amounts of water. This also holds true of the case where a concentration sensor (densimeter or the like) is used, and these level sensors and concentration sensors are high in cost, and therefore lack practicality.

In addition, there has been proposed a technique in which monitoring processing tanks are provided in addition to actual processing tanks, and water is added to the actual processing tanks on the basis of the degrees of evaporation of the processing tanks (refer to Japanese Patent Application Laid-Open Nos. 254959/1989 and 254960/1989). According to this technique, it is possible to obtain data which is equivalent to actual amounts of evaporation, so that the reliability improves. However, since the above-described water adding system requires the monitoring processing tanks in addition to the actual processing tanks, there are problems in that the apparatus becomes large in size, and that the number of components used increases. In addition, there is a problem in that management and maintenance for maintaining the monitoring processing tanks under conditions equivalent to those of the actual processing tanks become complicated.

To overcome the above-described problems, there has been proposed a water adding method in which an ambient condition such as a wet, standard, dry, or other similar condition is determined, a coefficient of correction fi of an amount of water to be added is determined by estimating the speed of evaporation of water from the processing solution on the basis of the ambient condition determined, thereby to determine the amount of water to be added (refer to Japanese Patent Application Laid-Open No 4-1756). In this water adding method, it is possible to obtain outstanding advantages in that highly reliable, appropriate amounts of water to be added can be obtained without using special equipment such as the monitoring processing tanks for obtaining the amounts of water to be added, i.e., amounts of evaporation of water, and that the efficiency in management and maintenance can be improved.

With the above-described water adding method, however, it is necessary for the operator (or a servicer of the manufacturer) to determine the ambient condition, such as the wet, standard, dry, or other similar condition. In general, the operator determines the ambient condition by measuring the temperature and humidity, but skill is required in estimating the speed of evaporation of water from the processing solutions on the basis of the temperature and humidity. If the operator does not have knowledge about evaporation, there is a possibility that he or she may make an error in determining the ambient condition. For instance, in the case of the ambient condition where the temperature is 25° C. and the humidity is 35%, if a comparison is made with the ambient condition where the temperature is 15° C. and the humidity is 65%, the speed of evaporation of water from the processing solutions is practically the same. Yet, since the humidity is 35%, there is a possibility of the ambient condition being determined as "dry."

In addition, in automatic processors, replenishers for the processing solutions are replenished in proportion to the amounts of the photosensitive material processed, the amount of oxidation due to air, and the like. For this reason, in the automatic processors in which the amount of the photosensitive material processed is large, large amounts of replenishers are replenished relative to the amounts of evaporation from the processing solutions, and the processing solutions do not undergo large variations in the concentration even if the aforementioned determination of the ambient condition is mistaken. However, in the automatic processors in which the amounts of the photosensitive material processed is small, small amounts of replenishers are replenished relative to the amounts of evaporation from the processing solutions, so that the concentrations of the processing solutions increase more rapidly. In this case, an erroneous determination of the ambient condition results in a substantial change in the concentrations of the processing solutions, thereby exerting a large influence on the finishing quality and the like in the processing of the photosensitive material.

In addition, recent automatic processors are designed to consume less amounts of replenishers per predetermined amount of photosensitive material processed (e.g., the amount of replenishment per film is less than half the conventional level). As the automatic processors requiring less amounts of replenishers, it is possible to cite, among others, the CN-16FA (trade name) made by Fuji Photo Film Co., Ltd., the C-41RA (trade name) made by Eastman Kodak Co., and the CNK-4-52 (trade name) made by Konica Corporation. With such automatic processors as well, the amounts of evaporation from the processing solutions remain practically the same as before, and the amounts of replenishers with respect to the amount of evaporation from the processing solutions are small. Hence, in the event that an error is made in the determination of the ambient condition, a large influence is exerted on the finishing quality.

SUMMARY OF THE INVENTION

In view of the above-described circumstances, it is an object of the present invention to provide a method and an apparatus for adding water to a photosensitive material processor which are capable of adding water so as to constantly maintain processing solutions at appropriate concentrations even in the case of a photosensitive material processor, such as an automatic processor, in which the amounts of replenishers added are small.

To this end, in accordance with a first aspect of the present invention for adding an amount of water corresponding to an amount of evaporation of a processing solution stored in a processing tank of the photosensitive material processor, to the processing tank, relationships between an ambient condition which is determined by one of an ambient temperature and an ambient relative humidity of the photosensitive material processor, an ambient vapor pressure, and ambient absolute humidity on the one hand, and the amount of evaporation of the processing solution on the other, are determined in advance; the ambient condition is detected; and the amount of water to be added to the processing tank is determined on the basis of the ambient condition detected and the relationships.

In addition, in accordance with a second aspect of the present invention for adding an amount of water corresponding to an amount of evaporation of a processing solution stored in a processing tank of the photosensitive material processor, to the processing tank, relationships among: an ambient condition which is determined by one of an ambient temperature and an ambient relative humidity of the photosensitive material processor, an ambient vapor pressure, and an ambient absolute humidity; a temperature of the processing solution; and the amount of evaporation of the processing solution, are determined in advance; the ambient condition and the temperature of the processing solution are detected; and the amount of water to be added to the processing tank is determined on the basis of the ambient condition and the temperature of the processing solution detected and the relationships.

If it is assumed that the temperature of the processing solution is fixed in the photosensitive material processor, fixed relationships exist between the ambient temperature and ambient relative humidity of the photosensitive material processor on the one hand, and the amount of evaporation from the processing solution on the other. For this reason, in accordance with the first aspect of the present invention, relationships between the ambient temperature and ambient relative humidity of the photosensitive material processor on the one hand, and the amount of evaporation from the processing solution on the other, are determined in advance. Then, the amount of water to be added to the processing solution is determined on the basis of the temperature and the relative humidity detected and the relationships. As a result, the operator need not determine the ambient condition such as a wet condition, a standard condition, and a dry condition on the basis of the ambient temperature and relative humidity, and cases where an erroneous amount of water to be added is set on the basis of the ambient condition determined erroneously are nil. Hence, even with an automatic processor in which the amounts of replenishers replenished are small, it is possible to add water in such a manner as to constantly maintain the concentrations of the processing solutions at appropriate levels.

In addition, if it is assumed that the temperature of the processing solution is fixed in the photosensitive material processor, a substantially inversely proportional relationship exists between the ambient vapor pressure of the photosensitive material processor and the amount of evaporation from the processing solution, so that the amount of evaporation from the processing solution can be obtained by using the vapor pressure. It should be noted that the vapor pressure can be indirectly detected by detecting the temperature and the relative humidity or the temperature and the absolute humidity, and by calculating the vapor pressure from the temperature and the relative humidity or the temperature and the absolute humidity detected.

For this reason, in the first aspect of the present invention, relationships between the ambient vapor pressure of the photosensitive material processor and the amount of evaporation from the processing solution are determined in advance. Then, the amount of water to be added to the processing solution is determined on the basis of the vapor pressure detected and the relationships. As a result, the operator need not determine the ambient condition such as a wet condition, a standard condition, and a dry condition on the basis of the ambient temperature and relative humidity, and cases where an erroneous amount of water to be added is set on the basis of the ambient condition determined erroneously are nil. Hence, even with an automatic processor in which the amounts of replenishers replenished are small, it is possible to add water in such a manner as to constantly maintain the concentrations of the processing solutions at appropriate levels.

In addition, if it is assumed that the temperature of the processing solution is fixed in the photosensitive material processor, with respect to the ambient absolute humidity of the photosensitive material processor as well, a substantially inversely proportional relationship exists between the ambient absolute humidity and the amount of evaporation from the processing solution in the same way as the aforementioned vapor pressure, so that the speed of evaporation from the processing solution can be obtained by using the absolute humidity. It should be noted that the absolute humidity can be directly detected by an absolute humidity sensor, or can be indirectly detected by detecting the temperature and the relative humidity and by calculating the absolute humidity from the temperature and the relative humidity detected.

For this reason, in the first aspect of the present invention, relationships between the ambient absolute humidity of the photosensitive material processor and the amount of evaporation from the processing solution are determined in advance. Then, the amount of water to be added to the processing solution is determined on the basis of the absolute humidity detected and the relationships. As a result, the operator need not determine the ambient condition such as a wet condition, a standard condition, and a dry condition on the basis of the ambient temperature and relative humidity, and cases where an erroneous amount of water to be added is set on the basis of the ambient condition determined erroneously are nil. Hence, even with an automatic processor in which the amounts of replenishers replenished are small, it is possible to add water in such a manner as to constantly maintain the concentrations of the processing solutions at appropriate levels.

In addition, in the photosensitive material processor, the amount of evaporation from the processing solution changes due to the temperature of the processing solution as well. For this reason, in the second aspect of the invention, relationships among an ambient condition, the temperature of the processing solution, and the amount of evaporation of the processing solution, are determined in advance. It should be noted that, as the ambient condition, it is possible to use one of an ambient temperature and ambient relative humidity of the photosensitive material processor, an ambient vapor pressure, and an ambient absolute humidity. As the aforementioned relationships, it is possible to use a change in the amount of evaporation with respect to changes in the ambient temperature and relative humidity and the temperature of the processing solution. Furthermore, it is possible to determine a change in the amount of evaporation with respect to the difference between the ambient vapor pressure and the saturated vapor pressure of the processing solution which changes with the temperature of the processing solution. Still further, it is possible to determine a change in the amount of evaporation with respect to a change in the absolute humidity of saturated humid air which is in equilibrium with the processing solution which changes with the ambient absolute humidity and the temperature of the processing solution.

In the present invention, the amount of water to be added to the processing solution is determined on the basis of the relationships between the ambient condition detected and the temperature of the processing solution. Thus, since the amount of evaporation from the processing solution can be determined by also taking the temperature of the processing solution into consideration, it is possible to obtain a more accurate amount of water to be added, and even with an automatic processor in which the amounts of replenishers replenished are small, it is possible to add water in such a manner as to constantly maintain the concentrations of the processing solutions at appropriate levels. In addition, an accurate amount of water to be added can be obtained when the temperature of the processing solution is changing or in the event that the set temperature of the processing solution is changed.

As described above, in accordance with the present invention, if the relationships between the ambient temperature and ambient relative humidity of the photosensitive material processor on the one hand, and the amount of evaporation of the processing solution on the other, are determined in advance, and if the amount of water to be added to the processing tank is determined on the basis of the temperature and humidity detected and the relationships, it is possible to obtain an outstanding advantage in that even with the automatic processor in which the amounts of replenishers replenished are small, it is possible to add water in such a manner as to constantly maintain the concentrations of the processing solutions at appropriate levels.

In addition, if the relationships between the ambient vapor pressure of the photosensitive material processor and the amount of evaporation of the processing solution are determined in advance, and if the amount of water to be added to the processing tank is determined on the basis of the vapor pressure detected and the relationships, it is possible to obtain an outstanding advantage in that even with the automatic processor in which the amounts of replenishers replenished are small, it is possible to add water in such a manner as to constantly maintain the concentrations of the processing solutions at appropriate levels.

Furthermore, if the relationships between the ambient absolute humidity of the photosensitive material processor and the amount of evaporation of the processing solution are determined in advance, and if the amount of water to be added to the processing tank is determined on the basis of the absolute humidity detected and the relationships, it is possible to obtain an outstanding advantage in that even with the automatic processor in which the amounts of replenishers replenished are small, it is possible to add water in such a manner as to constantly maintain the concentrations of the processing solutions at appropriate levels.

Still further, if the relationships among the ambient condition of the photosensitive material processor, the temperature of the processing solution, and the amount of evaporation of the processing solution are determined in advance, and if the amount of water to be added to the processing tank is determined on the basis of the ambient condition of the photosensitive material processor and the temperature of the processing solution detected as well as the relationships, it is possible to obtain an outstanding advantage in that even with the automatic processor in which the amounts of replenishers replenished are small, it is possible to add water in such a manner as to constantly maintain the concentrations of the processing solutions at appropriate levels.

The other objects, features and advantages of the present invention will become more apparent from the following detailed description of the invention when read in conjunction with the accompanying drawings.

DESCRIPTION OF THE PREFERRED EMBODIMENTS

Figure 1:
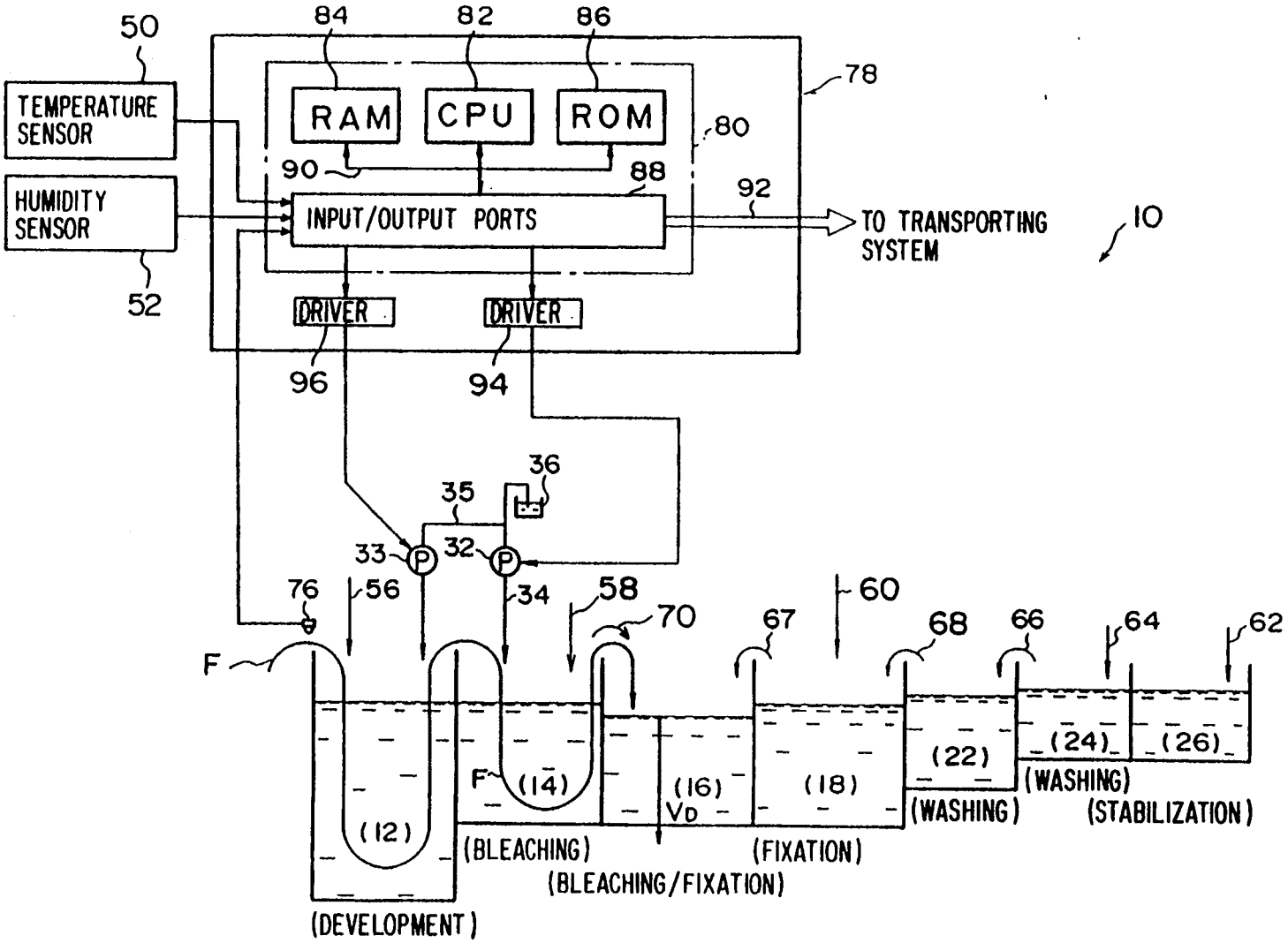
FIG. 1 is a schematic diagram of an automatic processor in accordance with a first and a second embodiment.

Referring now to the accompanying drawings, a detailed description will be given of a first embodiment of the present invention. It should be noted that although in the following embodiments a description will be given by using numerical values which do not cause hindrances to the present invention, the present invention is not restricted to the numerical values shown in the following embodiments. FIG. 1 shows an automatic processor 10 serving as a photosensitive material processor to which the present invention is applicable. In this automatic processor 10, a developing tank (N1) 12, a bleaching tank (N2) 14, a bleaching/fixing tank (N3-1) 16, a fixing tank (N3-2) 18, washing tanks (NS-1, NS2) 22 and 24, and a stabilizing tank (N4) 26 are arranged in that order. Various processing solutions including a developing solution, a bleaching solution, a bleaching-/fixing solution, washing water, and a stabilizing solution are stored in predetermined quantities in the respective tanks (hereafter collectively referred to as the processing tanks). A photosensitive material F, such as printing paper or film, which is set in the automatic processor 10 is transported by an unillustrated transporting system so as to be passed consecutively through the processing tanks, and is processed by being immersed in the processing solutions stored in the respective processing tanks.

In addition, an unillustrated drying station is disposed on the downstream side of the stabilizing tank 26 which is a final processing tank. The drying station has a heater and a fan, takes in air outside the body of the automatic processor 10 and heats the same, blows the heated air onto the photosensitive material F processed by being immersed in the processing solutions, thereby drying the photosensitive material. The aforementioned transporting system, whose operation is controlled by a controller 78, transports the photosensitive material F set in the automatic processor 10 from the developing tank 12 toward the drying station on the downstream side.

A passage sensor 76 for detecting the passage of the photosensitive material F is disposed in the vicinity of an inlet of the developing tank 12. A signal line of the passage sensor 76 is connected to input/output ports 88 of the controller 78, and the controller 78 is capable of detecting the passage of the photosensitive material F on the basis of a signal from the passage sensor 76. A water tank 36 is disposed in the vicinity of the processing tanks. This water tank 36 communicates with the bleaching tank 14 via a pipe 34. A pump 32 whose driving is controlled by the controller 78 is disposed in an intermediate portion of the pipe 34, so that water is supplied to the bleaching tank 14 as the pump 32 is driven.

One end of a pipe 35 is connected to the pipe 34 on the upstream side of its position where the pump 32 is disposed. The other end of the pipe 35 extends to the developing tank 12 to allow the water tank 36 and the developing tank 12 to communicate with each other. A pump 33 whose driving is controlled by the controller 78 is disposed in an intermediate portion of the pipe 35, so that water is supplied to the developing tank 12 as the pump 33 is driven.

Pipes indicated by arrows 56, 58, 60, and 62 for supplying replenishers are provided for the developing tank 12, the bleaching tank 14, the fixing tank 18, and the stabilizing tank 26, respectively. These pipes indicated by the arrows 56, 58, 60, and 62 are respectively connected to unillustrated replenisher supplying systems for supplying the replenishers. The replenishers are supplied to the processing tanks at predetermined timings via the corresponding pipes, respectively. In addition, the washing tank 24 is provided with a water supplying pipe indicated by an arrow 64. This water supplying tank is connected to an unillustrated water supplying system, so that a predetermined amount of water is supplied to the washing tank 24 via the water supplying tank.

Upper limits of the levels of the processing solutions are set in advance in the respective processing tanks. If the level of the washing water in the washing tank 24 has exceeded the upper limit, an excess portion of the washing water is sent to the washing tank 22 through an overflow indicated by an arrow 66. Meanwhile, if the level of the washing water in the washing tank 22 has exceeded the upper limit, an excess portion of the washing water is sent to the fixing tank 18 through an overflow indicated by an arrow 68. If the level of the fixing solution in the fixing tank 18 has exceeded the upper limit, an excess portion of the fixing solution is sent to the bleaching/fixing tank 16 through an overflow indicated by an arrow 67.

If the levels of the processing solutions in the developing tank 12, the bleaching/fixing tank 16, and the stabilizing tank 26 have exceeded the predetermined upper limits, excess portions of the processing solutions are discharged to the outside through unillustrated discharge pipes.

Each processing tank is provided with an unillustrated temperature adjusting means having a liquid temperature sensor and a heater. By means of the liquid temperature sensor, the temperature adjusting means detects the temperature of each processing solution, and the heater is controlled in such a manner that the temperature of the processing solution in each processing tank will be held at a preset level higher than the normal temperature.

As shown in FIG. 1, the controller 78 is constituted by a microcomputer 80. The microcomputer 80 includes a CPU 82, a RAM 84, a ROM 86, and the input-/output ports 88. These components are connected together by buses 90 constituted by such as data buses and control buses. Drivers 94 and 96 are connected to the input/output ports 88, and the pumps 32 and 33 are connected to the drivers 94 and 96, respectively.

A signal line 92 to the transporting system is connected to the input/output ports 88. Furthermore, a temperature sensor 50 and a humidity sensor 52 are connected to the input/output ports 88. The temperature sensor 50 and the humidity sensor 52 are disposed on the exterior of the automatic processor 10, and detect the temperature and relative humidity of the room environment where the automatic processor 10 is installed. It should be noted that positions where the temperature sensor 50 and the humidity sensor 52 are disposed suffice if they are located at positions which permit the detection of the temperature and relative humidity of the room environment where the automatic processor 10 is installed. For instance, the temperature sensor 50 and the humidity sensor 52 may be located inside the body of the automatic processor 10 to detect the temperature and relative humidity of the outside air taken into the interior of the apparatus body by a blower or the like.

As the temperature sensor 50, it is possible to use a thermistor temperature sensor which is generally used for detecting the temperature of warm air when the photosensitive material is dried. Alternatively, it is possible to use a thermocouple, a platinum resistance temperature detector, or a ceramic temperature sensor exhibiting a tungsten resistance pattern whose electric resistance value changes according to the temperature.

Meanwhile, as the humidity sensor 52, it is possible to use a humidity sensor which makes use of adsorption and desorption of water molecules by using an organic polymeric membrane which is generally used for detecting the temperature in air-conditioners, a humidity sensor which makes use of a change in the electrostatic capacity by using such as a polyamide humidity-sensitive material, or other similar humidity sensor. In this embodiment, as the aforementioned humidity sensor, the CHS-GS humidity sensor (trade name) made by TDK Electronics Co., Ltd. is used, and a temperature correction circuit for correcting an error of a detected value due to the relative degree of the temperature is used in combination. As the humidity sensor 52, it is also possible to use the KH-5100 humidity sensor (trade name) made by Kurabe Corp. or a ceramic humidity sensor (NHI-220: trade name) made by NOK Corp.

An operation expression (see the formula below) and the like for determining an amount of water to be added in processing for water addition control are stored in the ROM 86 of the microcomputer 80. The right-hand side of the following Formula (1) corresponds to the amount of evaporation from a processing tank.

$$\text{Water to be added} = TS \times VS + (TD \times VD + T0 \times V0) \times fi - \alpha \quad (1)$$

where,

TS: standby time (hour)
TD: drive time (hour)
T0: resting (night) time (hour)
VS: evaporation speed under standard conditions during standby (ml/hr)
VD: evaporation speed under standard conditions during operation (ml/hr)
V0: evaporation speed under standard conditions during resting (ml/hr)
fi: coefficient of correction (i=0, 1, 2)
i=0 standard condition
i=1 low-humidity condition
i=2 high-humidity condition
$\alpha$: constant (correction of cleaning water)

Figure 2:
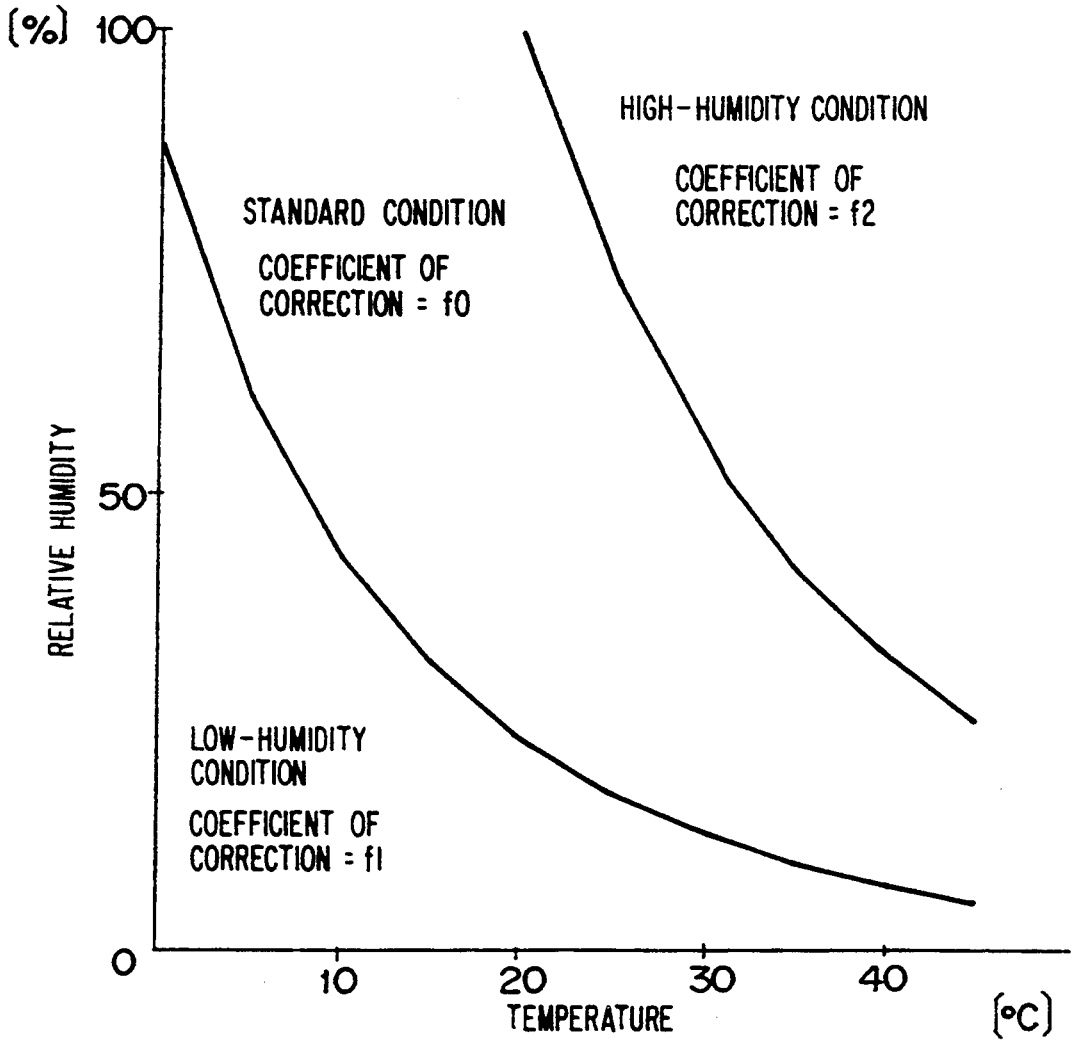
FIG. 2 is a diagram illustrating coefficients of correction concerning the ambient temperature and humidity of the automatic processor.

Also, a map showing the coefficient of correction fi in Formula (1) above, which, as shown in FIG. 2, corresponds to the ambient condition of the automatic processor 10 determined by the temperature and the relative humidity detected by the temperature sensor 50 and the humidity sensor 52, is stored in the ROM 86. The amounts of evaporation from the processing solutions change depending on the aforementioned ambient condition. The coefficient of correction fi is set so as to correct the amount of evaporation in correspondence with a change in the ambient condition (in this embodiment, the ambient condition includes three conditions, a standard condition, a low-humidity condition, and a high-humidity condition which are determined by the temperature and the relative humidity). In addition, parameters for determining the amounts of water to be added to the automatic processor 10 in accordance with Formula (1) above are stored in the RAM 84, including the evaporation speed under various operating conditions of each processing tank, values of the coefficient of correction under various ambient conditions, and so on, as shown in Table 1 below.

TABLE 1

| | VS (ml/h) | VD (ml/h) | V0 (ml/h) | f0 | f1 | f2 | $\alpha$ (ml) |
|---|---|---|---|---|---|---|---|
| N1 | 12.2 | 18.0 | 6.0 | 1.0 | 1.2 | 0.8 | 40 |
| N2 | 7.2 | 15.0 | 3.5 | 1.0 | 1.2 | 0.8 | 40 |
| N3 | 29.9 | 55.5 | 11.6 | 1.0 | 1.2 | 0.8 | 120 |
| N4 | 11.7 | 31.6 | 3.3 | 1.0 | 1.2 | 0.8 | 30 |

where,
N1: developing tank
N2: bleaching tank
N3: washing tank
N4: stabilizing tank where,
N1: developing tank
N2: bleaching tank
N3: washing tank
N4: stabilizing tank The controller 78 determines whether the ambient condition of the automatic processor 10 is the standard condition, the high-humidity condition, or the low-humidity condition, by referring to the map (FIG. 2) stored in the ROM 86 on the basis of the ambient temperature of the automatic processor 10 detected by the temperature sensor 50 and the ambient relative humidity detected by the humidity sensor 52. Then, by referring to the various parameters (Table 1) stored in the RAM 84, the controller 78 selects the coefficient of correction fi in correspondence with the environment thus determined, and determines an amount of water to be added in accordance with Formula (1) above.

It should be noted that the numerical values of the various parameters shown in Table 1 are determined by data in which the speed of evaporation from each processing tank is measured under various operating conditions including standby, drive, and resting conditions under a plurality of kinds of ambient conditions (in combinations of different temperatures and humidities), and by data in which the speed of evaporation from each processing tank is measured under the plurality of kinds of ambient conditions for each combination of a plurality of kinds of operating conditions assumed as a day's operating conditions. As an example of the measured data, Table 2 shows data in which the speed of evaporation per hour from the developing tank 12 was measured under the plurality of kinds of ambient conditions for each operating condition, as well as data in which the speed of evaporation per day from the developing tank 12 was measured under the plurality of kinds of ambient conditions by setting the standby time to 4 hours, the drive time to 4 hours, and the resting (night)

time to 16 hours as an example of an operating condition.

TABLE 2

| Ambient temperature, humidity | Evaporation Speed Standby (ml/h) | Drive (ml/h) | Night (ml/h) | Evaporation Amount (ml/day) 4S + 4D + 16N |
|---|---|---|---|---|
| 32° C./80% | 11.4 | 12.2 | 4.9 | 172.8 |
| 32° C./20% | 11.1 | 18 | 6.3 | 217.2 |
| 25° C./35% | 12.2 | 18.7 | 6.3 | 224.4 |
| 15° C./65% | 12.3 | 17.1 | 6.7 | 224.8 |
| 15° C./20% | 12.8 | 23.9 | 7.3 | 263.6 |

The drive condition among the operating conditions of the automatic processor 10 is the condition in which the photosensitive material F has been set and processing such as development is being effected. This is the condition in which the temperature of the processing solution in each processing tank is set in such a manner as to be maintained at a set temperature, and the heater and the fan in the drying station are operated. For this reason the amount of evaporation from each processing solution is large since the temperature of each processing solution is higher than the normal temperature, so that the evaporation speed is the fastest, as shown at VD in Table 1. In addition, as the drying station is operated, the air introduced into the body of the automatic processor 10 is heated and part of the warm air thereby produced circulates a processing station for accommodating the processing tanks. Accordingly, the environment in the processing station changes due to a change in the ambient conditions of the automatic processor 10, and the amounts of evaporation change. Hence, in Formula (1) above, the term (TD×VD) corresponding to the amount of evaporation in the drive condition is multiplied by the coefficient of correction fi.

On the other hand, the standby condition is a condition in which the automatic processor 10 is waiting for the photosensitive material F to be set in a state in which processing for such as development is possible. In this state, the temperature of the processing solution in each tank is adjusted to a set temperature, the heater and the fan in the drying station are stopped, and an unillustrated cover for covering the processing station is closed. Consequently, since the air in the processing station stagnates without circulating therein, the processing solutions are unlikely to be affected by changes in the surrounding environment, and even if the ambient conditions of the automatic processor 10 change, the changes in the amounts of evaporation are small. Accordingly, in Formula (1) above, the term (TS×VS) corresponding to the amount of evaporation in the standby condition is not multiplied by the coefficient of correction fi.

Furthermore, the resting condition is a condition in which processing is stopped such as during night. In this condition, the processing solutions in the processing tanks are preheated and their temperatures are set to levels lower than the set temperatures, the heater and the fan in the drying station are stopped, and the cover for covering the processing station is made open to prevent the evaporated water from forming dew in the processing station. Hence, the amounts of evaporation from the processing solutions are small, and since the ambient air of the automatic processor 10 enters the interior of the processing station, the processing solutions are apt to be affected by changes in the surrounding environment. Accordingly, in Formula (1) above, the term (T0×V0) corresponding to the amount of evaporation in the resting condition is multiplied by the coefficient of correction fi.

Figure 3:
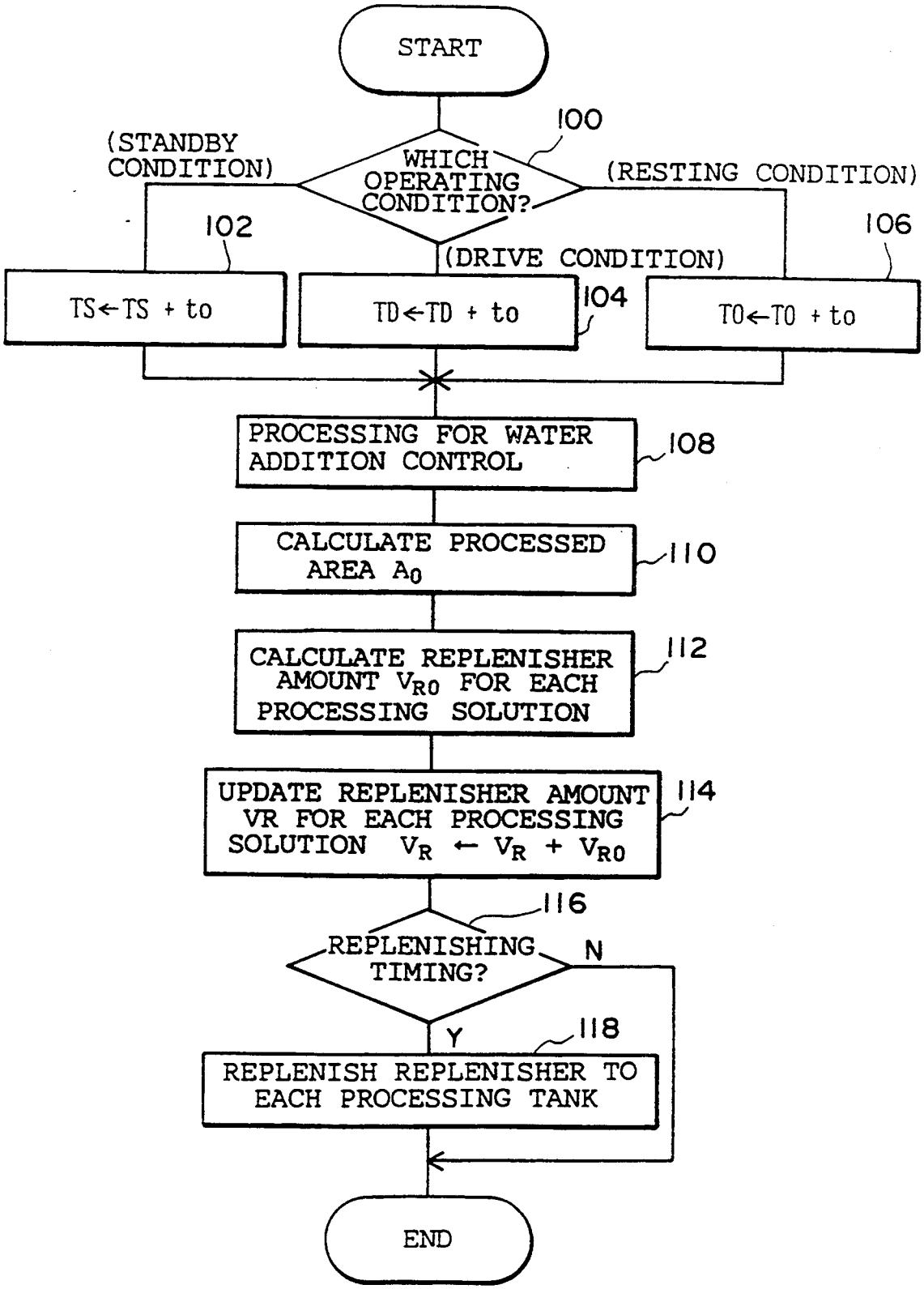
FIG. 3 is a flowchart illustrating a main routine in accordance with the first embodiment.
Figure 4:
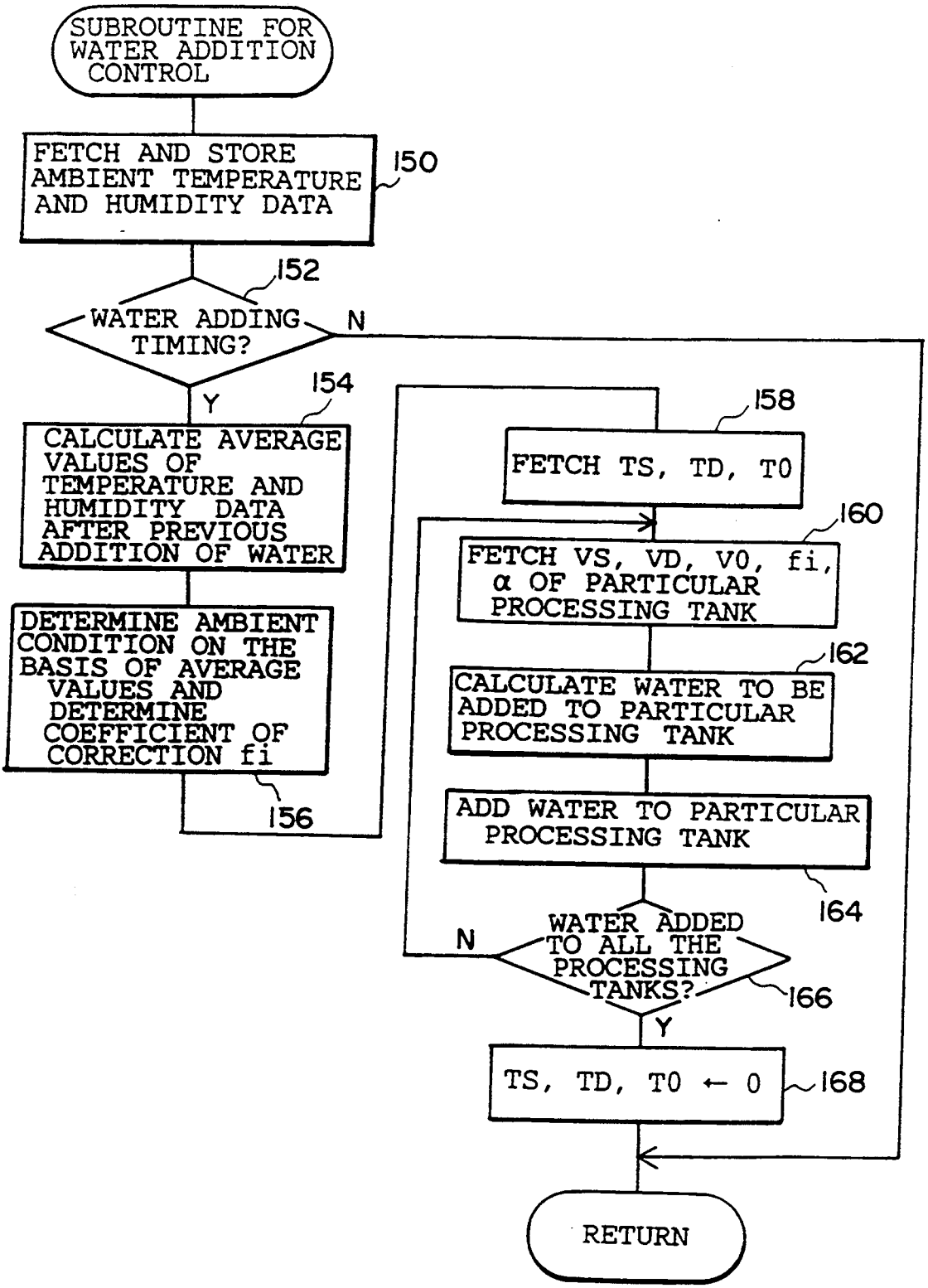
FIG. 4 is a flowchart illustrating a subroutine for controlling the addition of water in accordance with the first embodiment.

Referring now to the flowcharts shown in FIGS. 3 and 4, a description will be given of the operation of the first embodiment. The photosensitive material F is transported consecutively from the developing tank 12 to the bleaching tank 14 and the bleaching/fixing tank 16 so as to be subjected to processing such as development and bleaching. After the photosensitive material F is passed through the stabilizing tank 26, the photosensitive material F is dried. It should be noted that the flowchart shown in FIG. 3 is executed every predetermined time to (e.g., every 5 minutes) and is executed even if in the resting condition in which the main switch of the automatic processor 10 is turned off and the processing solutions are being preheated.

In Step 100, a determination is made as to whether the present operating condition is the drive condition, the standby condition, or the resting condition. If it is determined that the present operating condition is the standby condition, a value in which the aforementioned predetermined time $t_0$ is added to the previously calculated standby time TS is set as a new standby time TS in Step 102. If it is determined that the present operating condition is the drive condition, a value in which the predetermined time $t_0$ is added to the previously calculated drive time TD is set as a new drive time TD in Step 104. If it is determined that the present operating condition is the resting condition, a value in which the predetermined time $t_0$ is added to the previous resting time T0 is set as a new resting time T0 in Step 106.

In an ensuing Step 108, processing for water addition control is performed. Referring to the flowchart in FIG. 4, a detailed description will be given of this processing for water addition control. In Step 150, the ambient temperature and relative humidity of the automatic processor 10 detected by the temperature sensor 50 and the humidity sensor 52 are retrieved and are stored in the RAM 84. In Step 152, a determination is made whether or not a water adding timing has arrived. In this first embodiment, the time when the main switch of the automatic processor 10 is turned on is set as the water adding timing. If NO is the answer in the determination in Step 152, the operation proceeds to Step 110 of the main routine shown in FIG. 3. Therefore, until the time when the water adding timing has arrived, data on the ambient temperature and relative humidity are accumulated in the RAM 84 for each predetermined timing $t_0$.

Meanwhile, if YES is the answer in the determination in Step 152, the operation proceeds to Step 154. In Step 154, the temperature data and the humidity data accumulated in the RAM 84 after the previous water addition processing are fetched, and average values of the temperature and the relative humidity are calculated. In Step 156, on the basis of the average values of the humidity and the relative humidity, the ambient condition is determined by referring to the map of FIG. 2 and the value of i of the coefficient of correction fi is determined, thereby determining the coefficient of correction for each processing tank. In an ensuing Step 158, the standby time TS, the drive time TD, and the resting time T0 determined in Steps 102, 104, and 106 are retrieved.

In Steps 160 to 164, processing of addition of water to a particular processing tank which is subject to water addition processing is performed. Namely, in Step 160, by referring to the groups of parameters shown in Table 1 and stored in the RAM 84, the evaporation speed VS during standby, the evaporation speed VD during driving, the evaporation speed V0 during resting, the coefficient of correction fi (i=0, 1 or 2), and the constant $\alpha$ are retrieved for the particular processing tank. In Step 162, the amount of water to be added to the particular processing tank is calculated in accordance with Formula (1). In Step 164, the pump is driven on the basis of the calculated amount of water to be added so as to effect the processing of adding water to the particular processing tank.

In Step 166, a determination is made as to whether or not the processing of adding water to all the processing tanks which were subject to the water addition processing has been completed. If NO is the answer in the determination in Step 166, the operation returns to Step 160 to perform the processing of addition of water to another processing tank subject to the water addition processing. If YES is the answer in the determination in Step 166, the standby time TS, the drive time TD, and the resting time T0 are set to 0 in Step 168 to effect initialization, and the operation returns to Step 110 in the main routine of FIG. 3.

In Step 110 in the main routine, a processed area $A_0$ of the photosensitive material F since the previous execution of the main routine, i.e., the processed area $A_0$ of the photosensitive material F during the predetermined time $t_0$, is calculated. In an interruption routine which is executed every unit time (e.g., one minute), this processed area $A_0$ can be calculated by totalizing the time duration when the photosensitive material f passes by the location of the passage sensor 76 on the basis of the signal from the passage sensor 76, and by multiplying the totalized value by the transport speed of the transporting system and the widthwise dimension of the photosensitive material F.

In Step 112, an amount of replenisher, $V_{R0}$, necessary for recovering from the deterioration of the processing solution in each processing tank is calculated for each processing tank on the basis of the processed area $A_0$ calculated. In Step 114, the amount of replenisher, $V_{R0}$, for each processing tank is added to a totalized value $V_R$ of the amount of replenisher for each processing tank. In Step 116, a determination is made as to whether or not a timing for replenishing the replenisher has arrived. If NO is the answer in the determination in Step 116, processing ends.

When the processed area of the photosensitive material F reaches a portion of five films, a determination is made that the timing for replenishing the replenisher has arrived. Hence, in Step 118, each pump is driven to replenish an amount of replenisher corresponding to the totalized value $V_R$ to each processing tank, and the totalized value $V_R$ is set to 0, thereby completing processing. As this process of replenishment of the replenisher is repeated, the processing capabilities of the processing solutions can be constantly maintained at predetermined levels.

Thus, in this first embodiment, the relationships between the ambient temperature and relative humidity on the one hand, the coefficient of correction fi on the other, are stored as a map, parameters such as the evaporation speed for calculating the amounts of evaporation are stored, and the amounts of water to be added are determined on the basis of the ambient temperature and relative humidity detected by the temperature sensor 50 and the humidity sensor 52 and the stored relationships and parameters, as described above. Therefore, the operator need not determine the ambient conditions such as the wet, standard, and dry conditions, and cases where erroneous amounts of water to be added are set on the basis of the ambient conditions determined erroneously are nil. Hence, even with an automatic processor in which the amounts of replenishers replenished are small, it is possible to add water in such a manner as to constantly maintain the concentrations of the processing solutions at appropriate levels.

Although, in this first embodiment, the relationships between the ambient temperature and relative humidity on the one hand, the coefficient of correction fi on the other, are stored as a map, and parameters such as the evaporation speed for calculating the amounts of evaporation are stored, an arrangement may be alternatively provided such that the relationships between the ambient temperature and replenisher humidity on the one hand, and evaporation speed corrected in correspondence with the temperature and the relative humidity (e.g., VD×fi, V0×fi, etc.) on the other, are stored, and the amounts of water to be added are determined by the product of the evaporation speed and the time.

A second embodiment of the present invention will be described hereafter with reference to the drawings. It should be noted that portions identical to those of the first embodiment will be denoted by the same reference numerals, and a description thereof will be omitted.

In this second embodiment, an operation expression (see the formula below) for determining the ambient vapor pressure P from the ambient temperature and relative humidity of the automatic processor 10 detected by the temperature sensor 50 and the humidity sensor 52 is stored in the ROM 86

$$P=\phi P_s \text{ (mmHg)} \quad (2)$$

and $$\begin{aligned} \ln Ps = & -5.8002206 \times 10^3 \div T + 1.3914993 \\ & -4.8640239 \times 10^{-2} \times T + 4.1764768 \times 10^{-5} \times T^2 \\ & -1.4452093 \times 10^{-8} \times T^3 + 6.5459673 \ln T \ldots (3) \end{aligned}$$

where, $P_s$: vapor pressure of saturated humid air [mmHg]

T: absolute temperature (=t+273.15) [K]

t: temperature [°C.]

$\phi$: relative humidity [%]

Table 3 below shows the results in which saturated vapor pressure $P_s$ and vapor pressure P under the various ambient conditions (combinations of temperature and humidity) similar to those of Table 2 are calculated in accordance with Formula (2), as well as the order of the magnitude of the amount of evaporation (evaporation speed) from the actual processing solution.

TABLE 3

| Ambient temperature, humidity | Saturated vapor pressure $P_s$ (mmHg) | Vapor pressure P (mmHg) | Absolute humidity (kg/kg - dry air) | Actual amount of evaporation (in descending order) |
|---|---|---|---|---|
| 32° C./80% | 35.4 | 28.3 | 0.0241 | 4 |
| 32° C./20% | 35.4 | 7.1 | 0.0058 | 2 |
| 25° C./35% | 23.6 | 8.2 | 0.0068 | 3 |
| 15° C./65% | 12.7 | 8.2 | 0.0068 | 3 |
| 15° C./20% | 12.7 | 2.5 | 0.0021 | 1 |

If a comparison is made between Tables 2 and 3, it is evident that the ambient vapor pressure P of the automatic processor 10 and the amount of evaporation (evaporation speed) per unit time from the processing solution are substantially in a relationship of inverse proportion. In this second embodiment, the coefficient of correction fi is determined on the basis of the vapor pressure P as follows, for example.

$P<4.0$: low-humidity condition f1 ($=1.2$)

$4.0<P<17.5$: standard condition f0 ($=1.0$)

$P>17.5$: high-humidity condition f2 ($=0.8$)

Figure 5A:
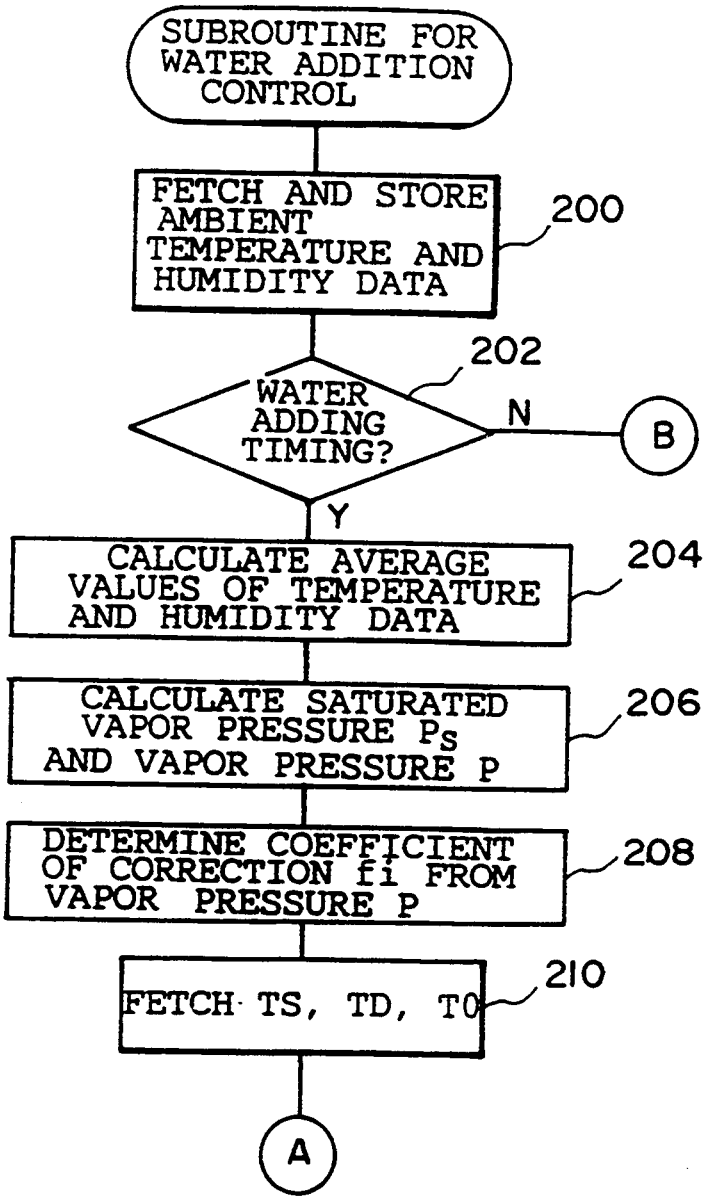
FIGS. 5A and 5B are flowcharts illustrating a subroutine for controlling the addition of water in accordance with the second embodiment.
Figure 5B:
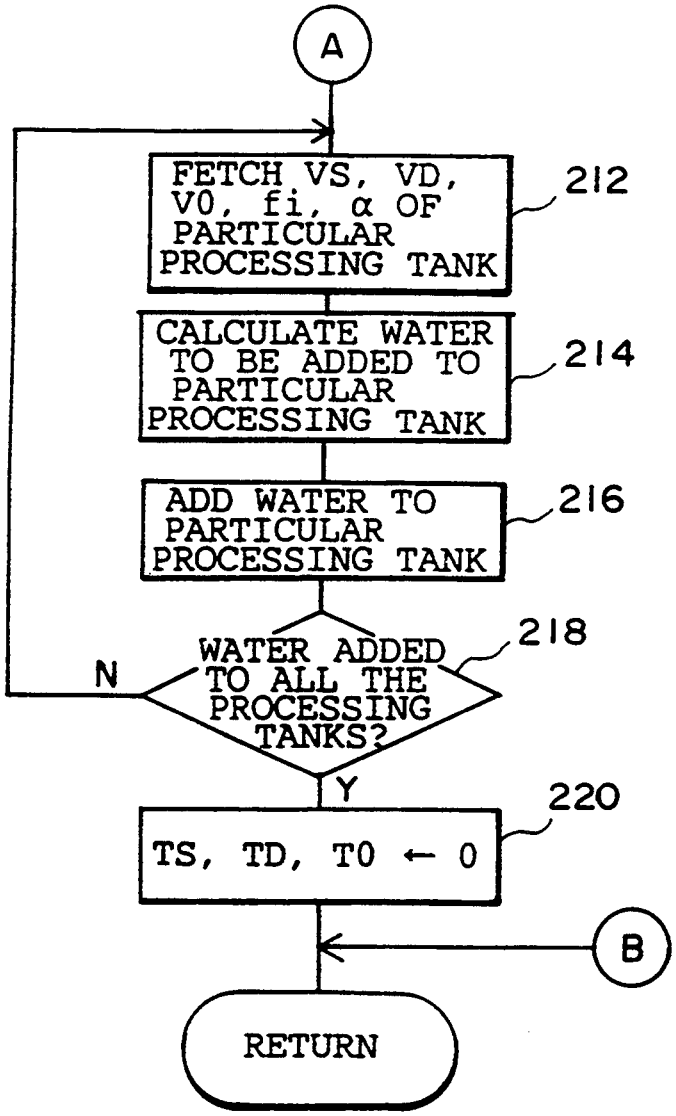
Figure 6:
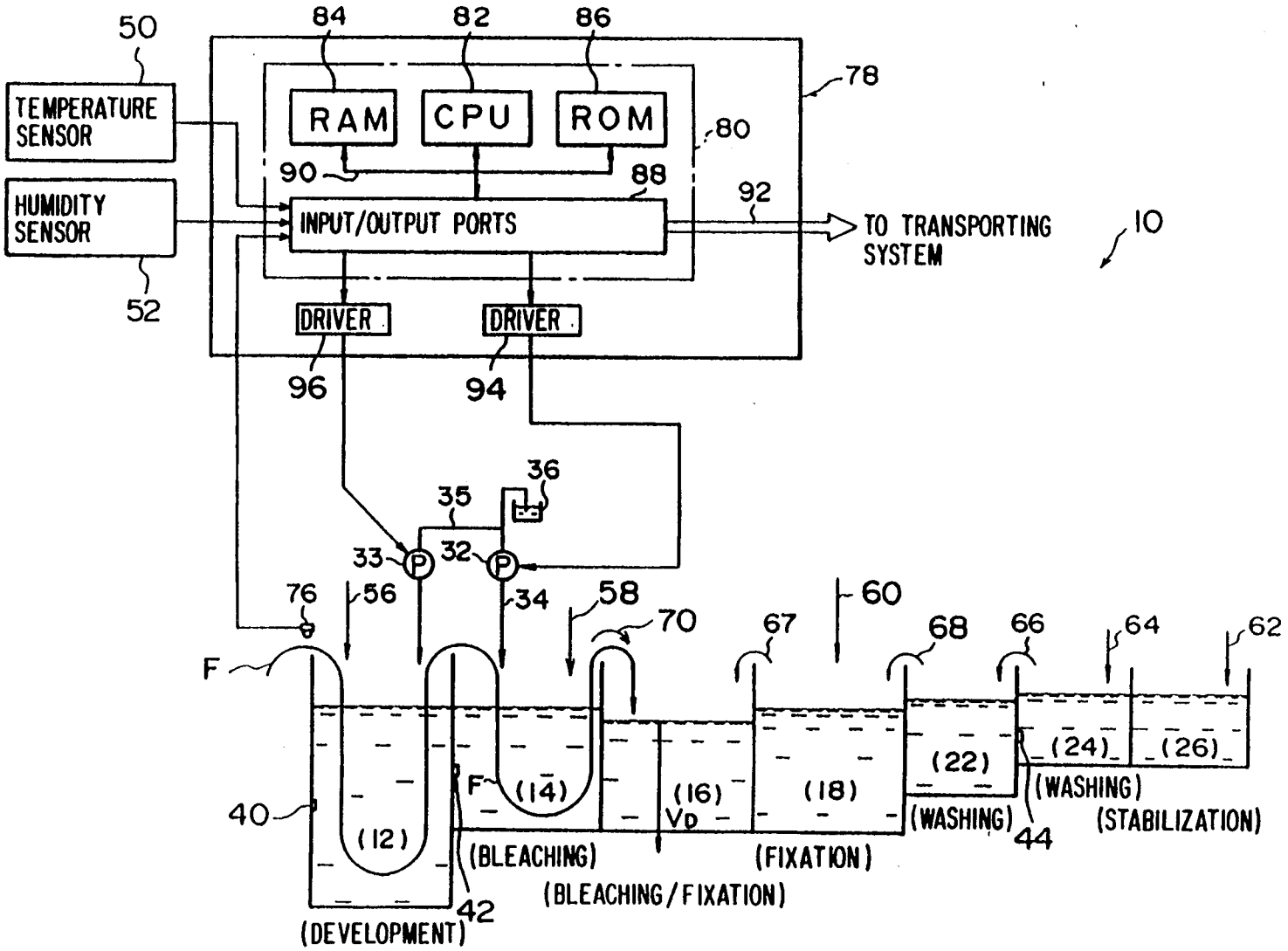
FIG. 6 is a schematic diagram of an automatic processor in accordance with a third embodiment.

Referring now to the flowcharts of FIGS. 5A and 5B, a description will be given of the processing for water addition control in accordance with this second embodiment. In Step 200, in the same way as in Step 150 in the flowchart of FIG. 4, the ambient temperature and relative humidity of the automatic processor 10 detected by the temperature sensor 50 and the humidity sensor 52 are fetched and are stored in the RAM 84. When a water adding timing has arrived, and YES is given as the answer in the determination in Step 202, the temperature data and the humidity data accumulated in the RAM 84 after the previous water addition processing are fetched, and average values of the temperature and the relative humidity are calculated in Step 204.

In Step 206, the ambient saturated vapor pressure $P_s$ is determined in accordance with Formula (3) above by using the average values of the temperature and the relative humidity, and the ambient vapor pressure P is then calculated in accordance with Formula (2) above. In an ensuing Step 208, a determination is made from the value of the vapor pressure P calculated in Step 206 as to whether the ambient condition is the standard condition, the low-humidity condition, or the high-humidity condition as described above, and the value of i in the coefficient of correction fi of the amount of evaporation is determined. In ensuing Steps 210 to 220, processing similar to that in Steps 158 to 168 is performed.

Namely, the standby time TS, the drive time TD, and the resting time T0 are fetched, parameters corresponding to each particular processing tank are fetched, the amount of water to be added is calculated in accordance with Formula (1), and the pump is driven on the basis of the calculated amount to be added, thereby effecting the water addition processing. After completion of the processing of adding water to all the processing tanks which were subject to the water addition processing, the standby time TS, the drive time TD, and the resting time T0 are set to 0, thereby completing processing.

Thus, in this second embodiment, the relationships between the ambient vapor pressure of the automatic processor 10 and the coefficient of correction fi are stored in advance, the ambient vapor pressure P is determined from the ambient temperature and relative humidity detected by the temperature sensor 50 and the humidity sensor 52, and the amount of water to be added is determined on the basis of this vapor pressure P and the stored relationships, as described above. Therefore, the operator need not determine the ambient conditions such as the wet, standard, and dry conditions, and cases where erroneous amounts of water to be added are set on the basis of the ambient conditions determined erroneously are nil. Hence, even with an automatic processor 10 in which the amounts of replenishers replenished are small, it is possible to add water in such a manner as to constantly maintain the concentrations of the processing solutions at appropriate levels.

Figure 9:
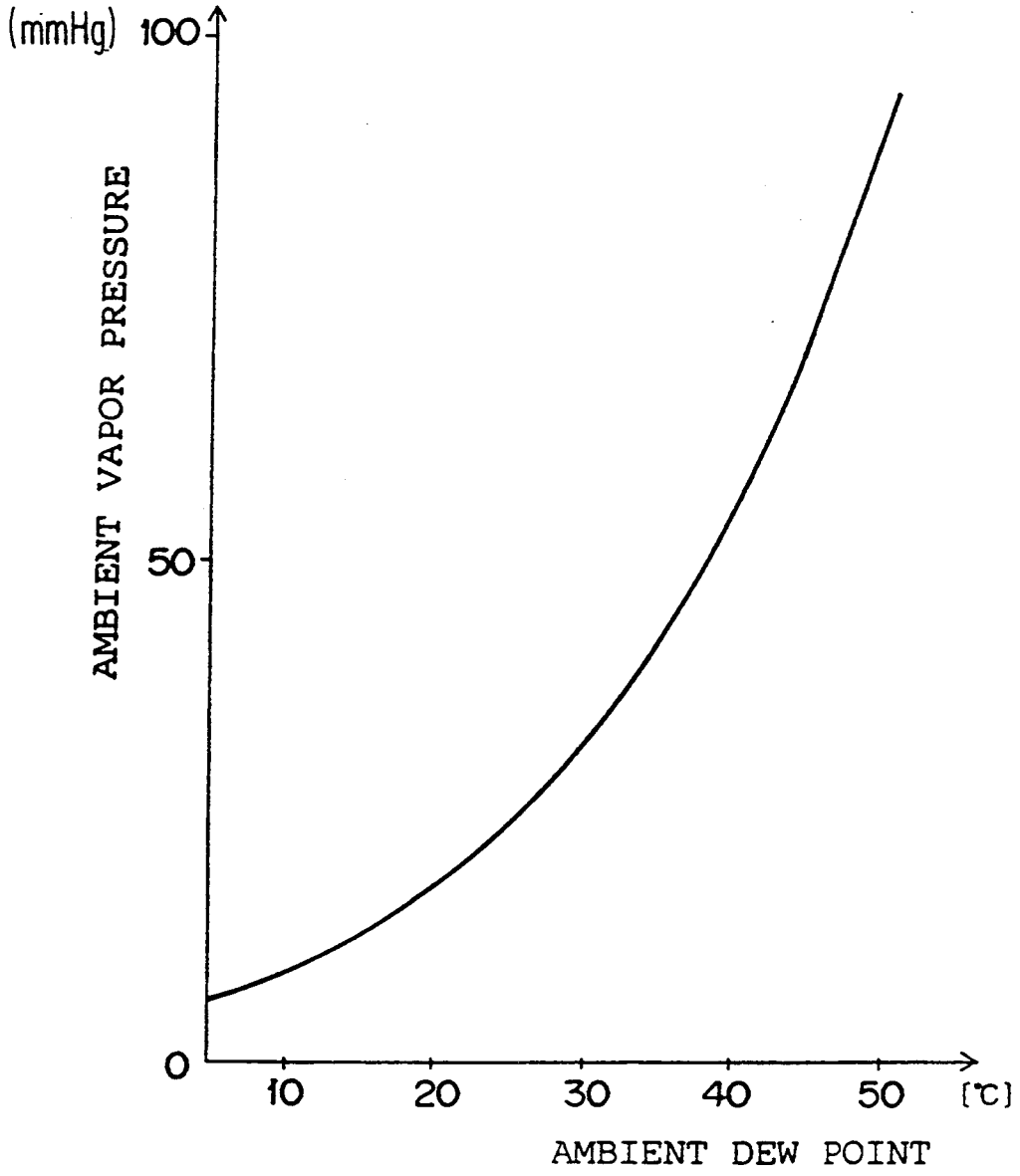
FIG. 9 is a diagram illustrating relationships between the ambient dew point and the ambient vapor pressure.

Although, in this second embodiment, the ambient vapor pressure P is determined from the ambient temperature and relative humidity of the automatic processor 10, an arrangement may be alternatively provided such that an ambient dew point (the temperature of saturated moist air having steam partial pressure equal to the steam partial pressure of moist air) is detected by means of, for instance, a dew-point hygrometer, and the vapor pressure P (steam partial pressure) is determined on the basis of the detected dew point. The dew-point hygrometer is so arranged that air is cooled by a Peltier element or the like, the temperature at which dew forms is measured, and this temperature is set as the dew point. The presence or absence of the dew condensation is optically or electrically detected. For instance, a mirror cooling dew-point hygrometer made by MBW Elektronik AG is so arranged that air is cooled by means of the Peltier element, the presence or absence of dew condensation on the mirror is optically detected, and the temperature of the mirror is detected by a platinum resistance sensor. In a SHAW dew-point hygrometer, the presence or absence of dew condensation is detected by detecting an electrostatic capacity. Meanwhile, a fixed relationship exists between the ambient dew point and the ambient vapor pressure P, as shown in FIG. 9. For this reason, the vapor pressure P can be determined from the dew point detected by the dew-point hygrometer on the basis of the vapor pressure curve of FIG. 9 or through a calculation.

In addition, although, in this second embodiment, the coefficient of correction fi is determined from the ambient vapor pressure P of the automatic processor 10, an arrangement may be alternatively provided such that the ambient absolute humidity H is determined from the aforementioned vapor pressure P, and the coefficient of correction fi is determined from this absolute humidity H. The absolute humidity H can be determined from, for instance, the following Formula (4).

$$H = 0.622 \times \frac{P}{760 - P} \tag{4}$$

The results of calculation of the absolute temperature H under various ambient conditions (combinations of temperature and humidity) similar to those of Table 2 are shown in Table 3 above. As is evident from Table 3, the ambient absolute humidity H of the automatic processor 10 and the amount of evaporation (evaporation speed) from the processing solution are substantially in a relationship of inverse proportion in the same way as the vapor pressure H. For this reason, the coefficient of correction fi can, for instance, be determined on the basis of the absolute humidity H as follows:

$H<0.0033$: low-humidity condition f1 ($=1.2$)

$0.0033<H<0.0147$: standard condition f0 ($=1.0$)

$H<0.0147$: high-humidity condition f2 ($=0.8$)

In addition, Formulae (2), (3), and (4) are approximate expressions, and in order to obtain more accurate values, it is conceivable to store a psychrometric chart in the ROM 86 and to determine the saturated vapor pressure $P_s$ and the vapor pressure P or the absolute humidity H although it is necessary to store huge volumes of data. Since Formulae (2), (3), and (4) make it possible to obtain sufficient accuracy (significant digits: 3 digits or thereabouts) within the range of usual room environments ($T=273.16-473.15$ K), particularly no problems are presented.

In addition, as the humidity sensor 52, it is possible to use a highly durable absolute humidity sensor to detect the ambient absolute humidity of the automatic processor 10. As described above, the ambient absolute humidity H (kg/kg-dry air) and the amounts of evaporation (evaporation speed) from the processing solution are substantially in a relationship of inverse proportion. For this reason, by using, for instance, an absolute humidity sensor (HSA-1H, HSA-2H, CHS-1, or CHS-2: trade names and made by Shibaura Electronics Co., Ltd.) having a thermistor and designed to detect the weight ($g/m^3$) of moisture contained in a unit volume as absolute humidity, the absolute humidity H (kg/kg-dry air) may be determined by correcting the weight ($g/m^3$) of moisture contained in a unit volume and detected by that absolute humidity sensor by means of the ambient temperature, so as to calculate an amount of evaporation from the processing solution.

Furthermore, if the humidity sensor 52 is arranged by an absolute humidity sensor incorporating a correction circuit and the like and designed to virtually detect the absolute humidity H (kg/kg-dry air), the amount of evaporation from the processing solution can be determined without using the temperature sensor 50, so that the calculation of the amount of water to be added can be simplified.

In addition, although, in this second embodiment, the vapor pressure P is determined by detecting the ambient temperature and relative humidity, the vapor pressure P may be determined by detecting the ambient temperature and absolute humidity.

Referring now to the accompanying drawings, a description will be given of a third embodiment of the present invention. It should be noted that portions identical to those of the first and second embodiments will be denoted by the same reference numerals, and a description thereof will be omitted.

In this third embodiment, the developing tank 12 is provided with a liquid temperature sensor 40 for detecting the temperature of the developing solution. The bleaching tank 14 is provided with a liquid temperature sensor 42 for detecting the temperature of the bleaching solution, while the washing tank 24 is provided with a liquid temperature sensor 44 for detecting the temperature of washing water. The liquid temperature sensors 40, 42, and 44 are respectively connected to the input/output ports 88 of the controller 78. It should be noted that since the processing tanks are provided with the temperature adjusting means having the liquid temperature sensor and the heater, as described before, the liquid temperature sensors 40, 42, and 44 can be omitted if an arrangement is provided such that processing which will be described later is performed by using a liquid-temperature detection signal outputted from the liquid temperature sensor of the temperature adjusting means.

In this third embodiment, the amount of water to be added is calculated by taking into consideration the temperature of the processing solution which is subject to water addition processing. First, a basic principle of this third embodiment will be described. Water or an aqueous solution (processing solution) at a predetermined temperature T is in equilibrium with saturated moist air at the predetermined temperature T, and the vapor pressure (saturated vapor pressure) $P_T$ of this saturated moist air can be calculated by using Formula (3) above. By way of example, saturated vapor pressure $P_{38}$ and absolute humidity $H_{38}$ of saturated moist air at a temperature of 38° C. and a relative humidity of 100%, which is in equilibrium of a processing solution at a temperature of 38° C., are as follows:

saturated steam pressure $P_{38}=49.3$ (mmHg)

absolute humidity $H_{38}=0.0432$ (kg/kg-dry air)

Hereafter, the saturated vapor pressure and absolute humidity of the aforementioned saturated moist air which is in equilibrium with the processing solution will be simply referred to as the saturated vapor pressure $P_T$ of the processing solution and the absolute humidity $H_T$ of the processing solution. By way of example, Table 4 below shows the results of calculation of the saturated vapor pressure $P_s$ and the vapor pressure P and differences between the saturated vapor pressure $P_{38}$ of the saturated moist air of 100% relative humidity and the ambient vapor pressure P under various ambient conditions (combinations of temperature and humidity) similar to those of Tables 2 and 3.

TABLE 4

| Ambient temperature, humidity | Saturated vapor pressure $P_s$ (mmHg) | Vapor pressure P (mmHg) | Difference in vapor pressure with respect to processing solution P38 - P (mmHg) |
|---|---|---|---|
| 32° C./80% | 35.4 | 28.3 | 21.0 |
| 32° C./20% | 35.4 | 7.1 | 42.2 |
| 25° C./35% | 23.6 | 8.2 | 41.1 |
| 15° C./65% | 12.7 | 8.2 | 41.1 |
| 15° C./20% | 12.7 | 2.5 | 46.8 |

Figure 10:
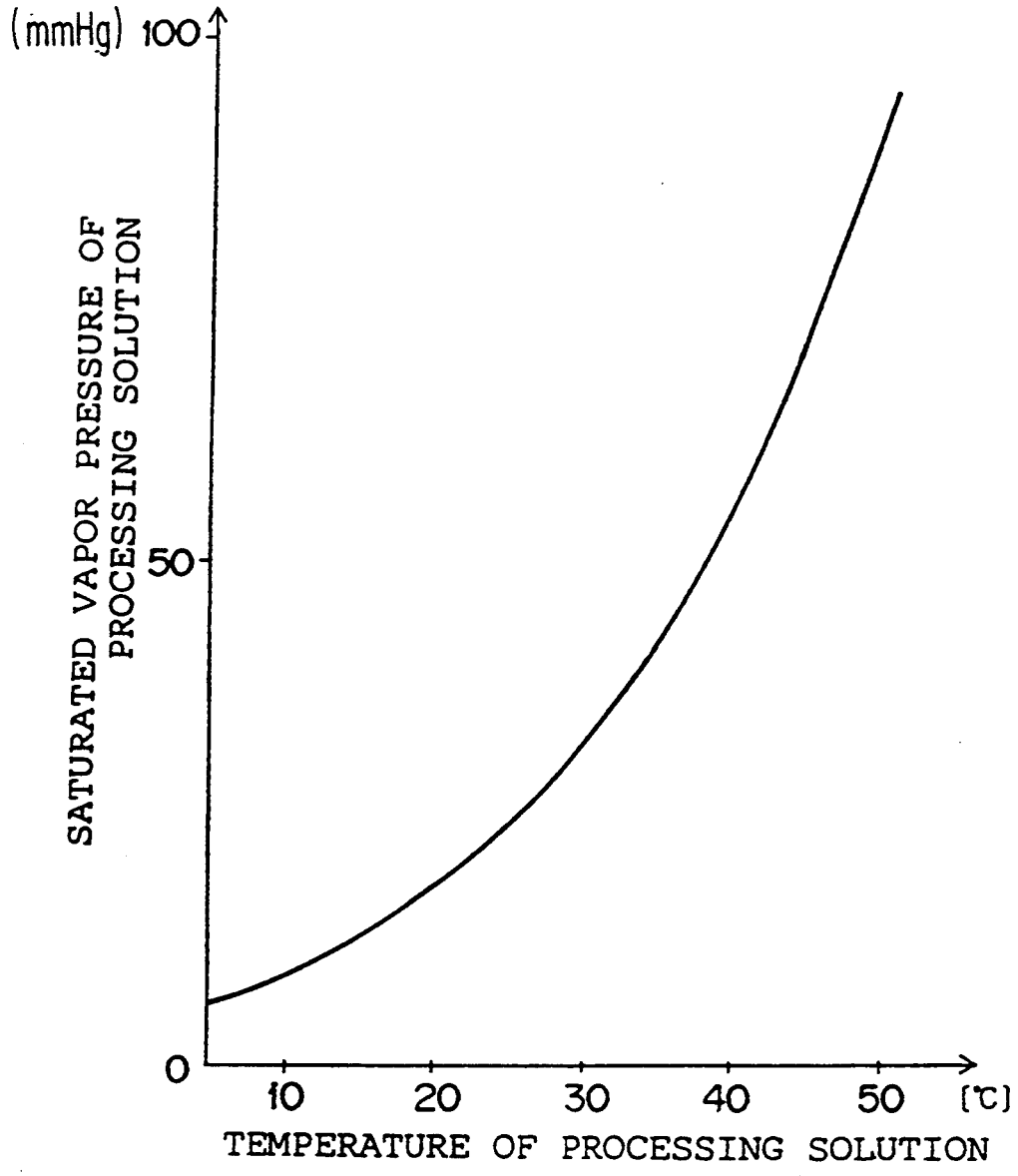
FIG. 10 is a diagram illustrating relationships between the temperature of a processing solution and saturated vapor pressure.

As is apparent from Table 4, the amount of evaporation (evaporation speed) from the processing solution becomes greater as the difference between the saturated vapor pressure $P_T$ of the processing solution and the ambient vapor pressure P becomes greater. In addition, if the temperature T of the processing solution increases (to 40° C., for instance), the amount of evaporation from the processing solution increases; however, since the saturated vapor pressure is a function having the temperature as a variable, as is apparent from Formula (3), the saturated vapor pressure $P_T$ of the processing solution also increases (see FIG. 10), so that the difference between the saturated vapor pressure $P_T$ of the processing solution and the ambient vapor pressure P also becomes large. In this third embodiment, the coefficient of correction fi is determined on the basis of the relative difference between the saturated vapor pressure $P_T$ of the processing solution and the ambient vapor pressure P in a case where the temperature of the processing solution is, for instance, 38° C., as follows:

$P_{38}-P>45.3$: f1 (=1.2)

$45.3<P_{38}-P<31.8$: f0 (=1.0)

$P_{38}-P<31.8$: f2 (=0.8)

As a result, it is possible to ascertain the amount of evaporation from the processing solution more accurately, and a more appropriate amount of water to be added can be calculated.

Figure 7A:
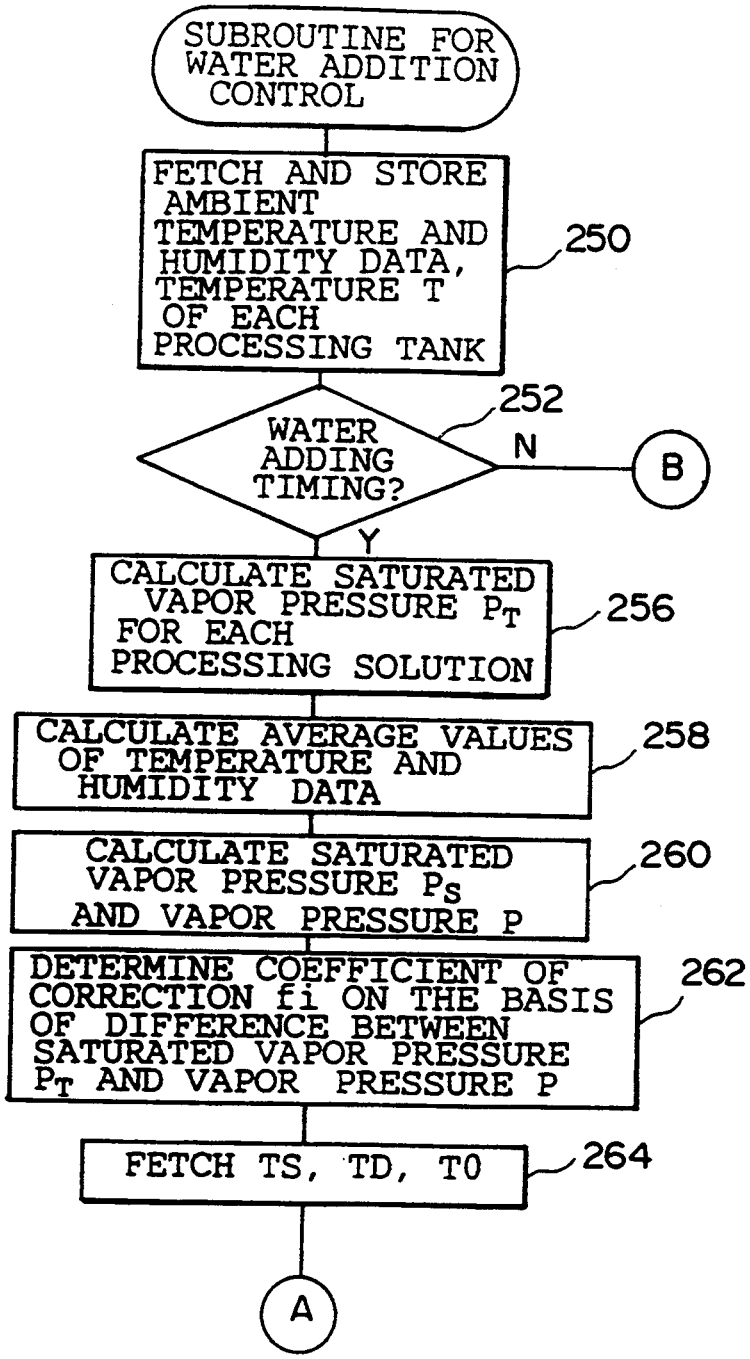
FIGS. 7A and 7B are flowcharts illustrating a subroutine for controlling the addition of water in accordance with the third embodiment.
Figure 7B:
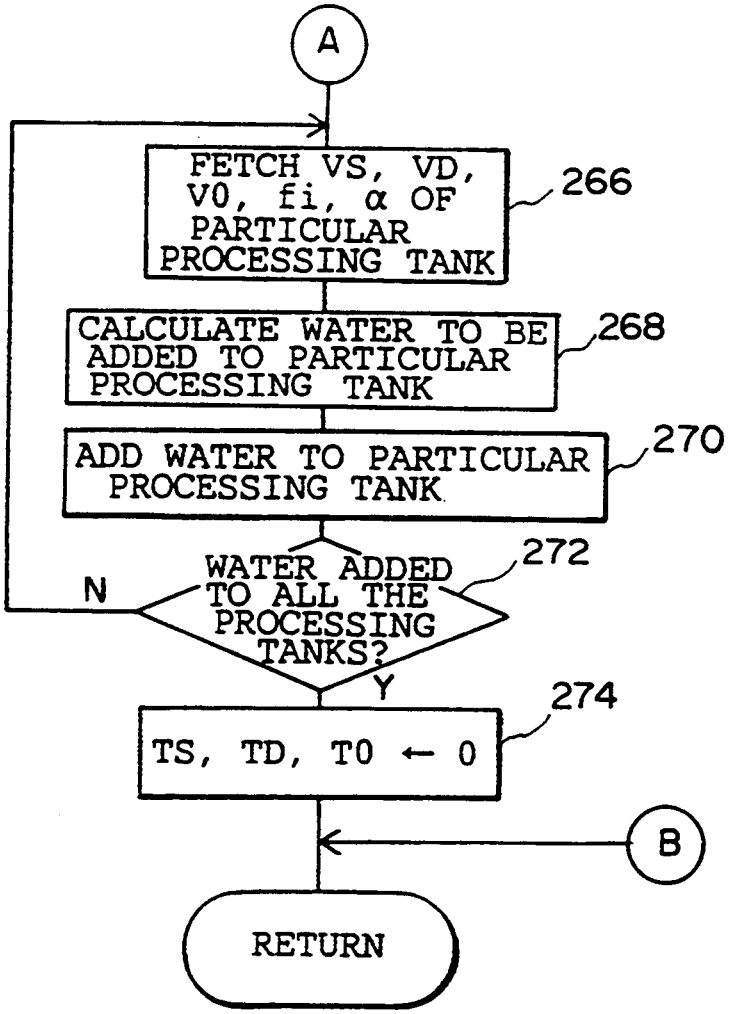

Referring now to the flowcharts of FIGS. 7A and 7B, a description will be given of the processing for water addition control in accordance with this third embodiment. In Step 250, in the same way as in Step 150 in the flowchart of FIG. 4, the ambient temperature and relative humidity of the automatic processor 10 detected by the temperature sensor 50 and the humidity sensor 52 are retrieved, and the temperatures T of the processing solutions detected by the liquid temperature sensors 40, 42, and 44 are also retrieved, and they are stored in the RAM 84. When a water adding timing has arrived, and YES is given as the answer in the determination in Step 252, in Step 256, an average value of the temperatures T stored in the RAM 84 is calculated, and the saturated vapor pressure $P_T$ is calculated for each processing solution in accordance with Formula (3) above.

In an ensuing Step 258, the temperature data and the humidity data accumulated in the RAM 84 after the previous water addition processing are retrieved, and average values of the temperature and the relative humidity are calculated. In Step 260, the ambient saturated vapor pressure $P_s$ is determined in accordance with Formula (3) by using the average values of the temperature and the relative humidity, and the ambient vapor pressure P is then calculated in accordance with Formula (2). In Step 262, the difference between the saturated vapor pressure $P_T$ for each processing solution calculated in Step 256 and the ambient vapor pressure P calculated in Step 260 is calculated respectively, and the value of i in the coefficient of correction fi of the amount of evaporation is determined for each processing solution.

In ensuing Steps 264 to 274, processing similar to that in Steps 158 to 168 is performed. Namely, the standby time TS, the drive time TD, and the resting time T0 are retrieved, parameters corresponding to each particular processing tank are retrieved, the amount of water to be added is calculated in accordance with Formula (1), and the pump is driven on the basis of the calculated amount to be added, thereby effecting the water addition processing. After completion of the processing of adding water to all the processing tanks which were subject to the water addition processing, the standby time TS, the drive time TD, and the resting time T0 are set to 0, thereby completing processing.

Thus, in this third embodiment, the coefficient of correction fi is determined on the basis of the relative difference, $P_T$—P, between the saturated vapor pressure $P_T$ of the processing solution and the ambient vapor pressure P, as described above. Therefore, in a case where the temperatures of the processing solutions are varied or the set temperatures of the processing solutions are altered, it is possible to obtain more accurate amounts of evaporation by incorporating changes in the amount of evaporation due to changes in the temperature of the processing solutions. Hence, it is possible to add more appropriate amounts of water.

Although, in this third embodiment, the coefficient of correction fi is determined on the basis of the relative difference, $P_T$—P, between the saturated vapor pressure $P_T$ of the processing solution and the ambient vapor pressure P to determine the amount of water to be added, it is possible to provide the following alternative arrangement: That is, relationships of change in the amount of evaporation with respect to changes in the ambient temperature and relative humidity and the temperature of the processing solution are determined in advance through experiments and the like, the ambient temperature and relative humidity and the temperature of the processing solution are detected, and the amount of water to be added is determined on the basis of the detected results and the relationships previously determined. Furthermore, an arrangement may be provided such that the relationships between the difference, $H_T$—H, between the absolute humidity $H_T$ of the processing solution and the ambient absolute humidity H on the one hand, and the amount of evaporation on the other, are determined in advance through experiments and the like, the absolute humidity $H_T$ of the processing solution and the ambient absolute humidity H are detected, and the amount of water to be added is determined on the basis of the detected results and the aforementioned relationships.

Next, a description will be given of a fourth embodiment of the present invention. It should be noted that a description of portions identical to those of the first to third embodiments will be omitted.

Figure 8A:
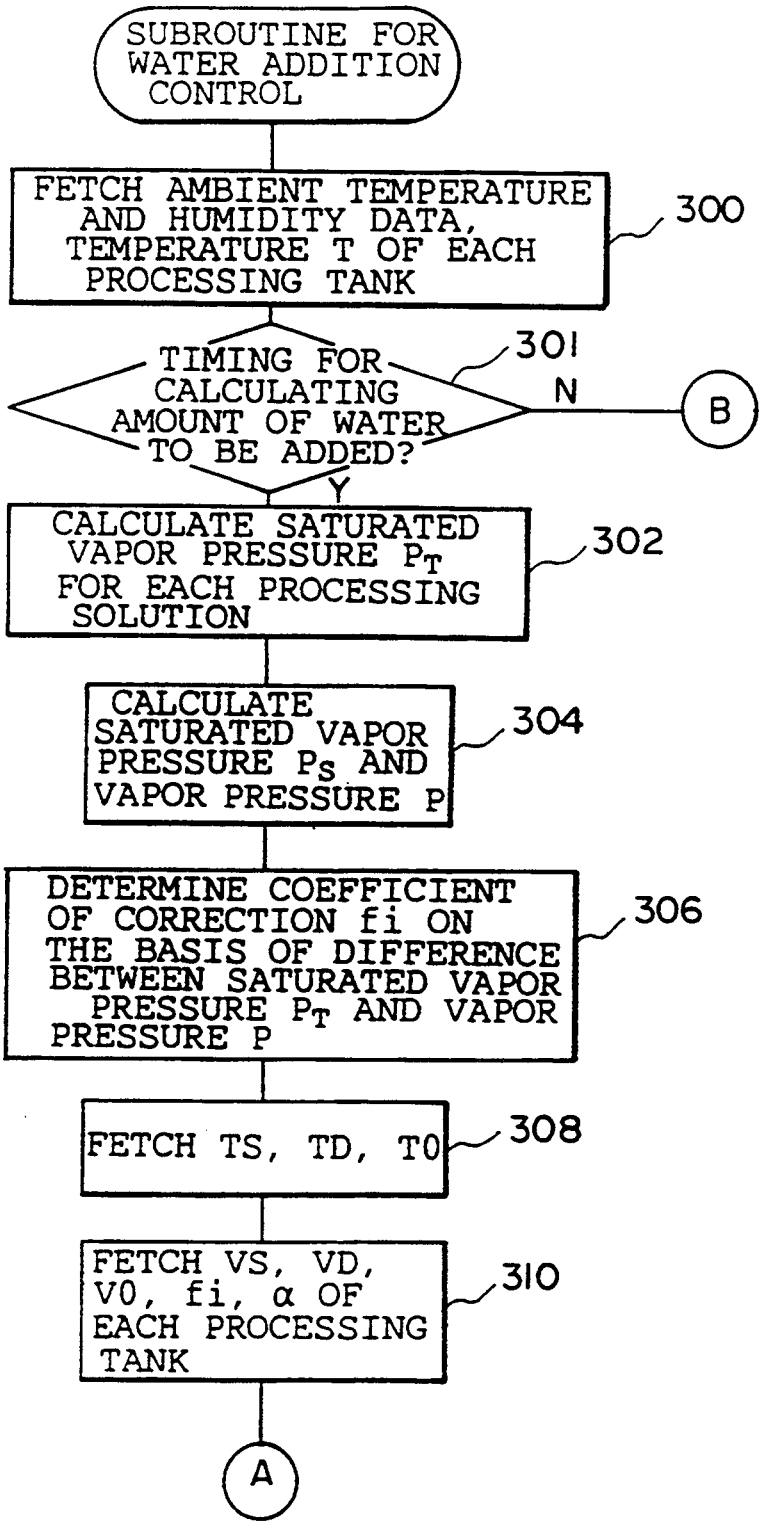
FIGS. 8A and 8B are flowcharts illustrating a subroutine for controlling the addition of water in accordance with a fourth embodiment.
Figure 8B:
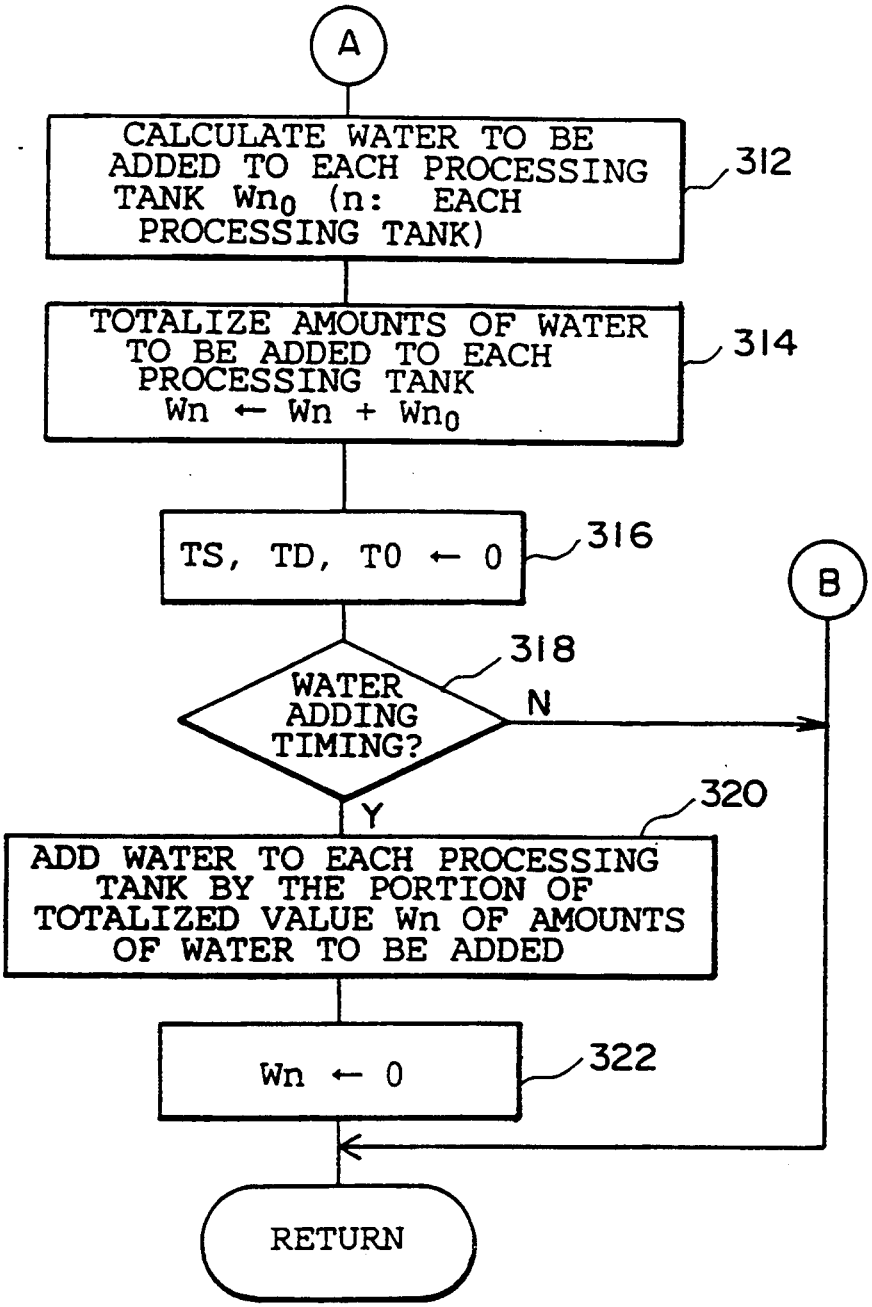

In this fourth embodiment, the amount of water to be added to each processing solution is calculated on the basis of the surrounding environment and the temperature of each processing solution for each predetermined time (e.g., every one hour), the calculated amounts of water to be added are totalized, and an accurately corresponding amount of water to be added is determined on the basis of the amount of evaporation. Referring to the flowcharts of FIGS. 8A and 8B, a detailed description will be given of the processing for water addition control which is effected for each predetermined time t0 (e.g., 5 minutes) in accordance with this fourth embodiment. In Step 300, the ambient temperature and relative humidity of the automatic processor 10 detected by the temperature sensor 50 and the humidity sensor 52, and the temperatures T of the processing solutions detected by the liquid temperature sensors 40, 42, and 44 are retrieved and are stored in the RAM 84.

In Step 301, a determination is made as to whether or not a timing for calculating the amount of water to be added has arrived. In this determination, YES is given as the answer when the main switch is turned on in the morning and after the lapse of each predetermined time $t_1$ ($t_1 > t_0$, e.g., one hour). If NO is given as the answer in the determination in Step 301, this processing for water addition control ends. Accordingly, until YES is given as the answer in the determination in Step 301, the ambient temperature and relative humidity and the temperature T of each processing solution are measured for each predetermined time $t_0$, and measured results are stored in the RAM 84.

If YES is the answer in the determination in Step 301, the operation proceeds to Step 302, average values of the temperatures T of the processing solutions stored in the RAM 84 are calculated, and by using these average values of the temperatures T, the saturated vapor pressure $P_T$ is calculated for each processing solution in accordance with Formula (3) above. In Step 304, average values of the ambient temperature and relative humidity stored in the RAM 84 are calculated, and by using these average values of the temperature and relative humidity, the ambient saturated vapor pressure $P_s$ is determined in accordance with Formula (3) above, and the ambient vapor pressure P is then calculated in accordance with Formula (2). In Step 306, the difference between the saturated vapor pressure $P_T$ for each processing solution calculated in Step 302 and the ambient vapor pressure P calculated in Step 304 is respectively calculated, and the coefficient of correction fi for calculating an amount of water to be added corresponding to the amount of evaporation for each processing solution within the aforementioned predetermined time $t_1$ is determined.

In an ensuing step 308, the standby time TS, the drive time TD, and the resting time T0 are retrieved. These times TS, TD, and T0 are set to 0 each time the processing for water addition control is executed, as will be described later. The time of the standby condition, the time of the drive condition, and the time of the resting condition after the previous processing for water addition control are stored as the TS, TD, and T0. For instance, in a case where the drive condition is continuing after the previous processing for water addition control, the standby time TS and the resting time T0 are set to 0.

In Step 310, the groups of parameters stored in the RAM 84 are referred to, and the evaporation speed VS during standby, the evaporation speed VD during drive, and the evaporation speed V0 during resting, the coefficient of correction fi, and the constant $\alpha$ which are set for each processing solution are retrieved. In Step 312, by using the TS, TD, and T0 fetched in Step 308 and the parameters retrieved in Step 310, an amount of water to be added, $Wn_0$ (n is an integer which differs for each processing solution), is calculated for each processing solution in accordance with Formula (1). As a result, this amount of water to be added, $Wn_0$, agrees with the amount of evaporation from each processing solution after the previous processing for water addition control. In Step 314, the amount of water to be added, $Wn_0$, is added to a totalized value Wn of the amount of water to be added to each processing tank. In Step 316, the standby time TS, the drive time TD, and the resting time T0 are set to 0, and the ambient temperature and relative humidity and the temperature T of each processing solution which are stored in the RAM 84 are cleared.

In an ensuing Step 318, a determination is made as to whether or not a water adding timing has arrived, and if NO is the answer in the determination in Step 318, this processing for water addition control ends. Accordingly, until the time when the water adding timing arrives, the amount of water to be added, $Wn_0$, for each processing solution is calculated on the basis of the ambient temperature and relative humidity and the temperature of each processing solution prevailing at the time when the processing for water addition control was executed, and is added to the totalized value Wn of the amount of water to be added to each processing solution. For instance, when the main switch of the automatic processor 10 is turned on, and YES is given as the answer in the determination in Step 318, the operation proceeds to Step 320, and the pumps are driven on the basis of the totalized values Wn of the amounts of water to be added to the respective processing tanks, so as to add water to the processing solutions. In Step 322, the totalized values Wn of the amounts of water to be added to the respective processing solutions are set to 0, and processing ends.

Thus, in this fourth embodiment, the coefficient of correction fi is determined on the basis of the ambient temperature and relative humidity and the temperature of each processing solution for each predetermined time $t_1$, the amount of water to be added, $Wn_0$, is determined in correspondence with the amount of evaporation for each predetermined time $t_1$ for each processing tank, and water is added on the basis of the totalized value Wn of the amount of water to be added $Wn_0$, as described above. Therefore, as compared with a case where the coefficient of correction fi is determined by using the average values in the manner of the first to third embodiments, it is possible to obtain more accurate amounts of water to be added corresponding to the portions of evaporation from the respective processing tanks. Hence, water can be added to allow the concentrations of the processing solutions to be constantly set to appropriate levels even in the case of the automatic processor 10 in which the amounts of replenishers to be replenished are small.

Although, in the foregoing embodiments, the values of the coefficient of correction fi are selected from among the three kinds of values in correspondence with the surrounding environment and the like, the values may be selected from among a greater number of kinds (e.g., five kinds) of values, or the values may be changed continuously in correspondence with changes in the ambient conditions. For example, although in the third embodiment the value of the coefficient of correction fi is determined to be one of 1.2, 1.0, and 0.8 on the basis of the difference, $P_T$—P, between the saturated vapor pressure PT of the processing solution and the ambient vapor pressure P, in a case where the temperature of the processing solution is, for instance, 38° C., the coefficient of correction fi may be determined through the following operation expression:

$$fi=0.0296\times(P_{38}-P)-0.14$$

Consequently, it is possible to ascertain the changes in the ambient conditions, including the temperature of the processing solution, in a continuous manner, so that evaporation correction can be effected with higher accuracy.

In addition, in Formula (1) used in the calculation of the amount of water to be added in the foregoing embodiments, the change in the amount of evaporation is small in the standby condition even if the ambient conditions of the automatic processor 10 change, so that the term for determining the amount of evaporation in the standby condition is not multiplied by the coefficient of correction fi in Formula (1). However, to obtain the amount of evaporation more precisely, that term may be multiplied by a different coefficient whose amount of change is smaller than the aforementioned coefficient of correction fi with respect to changes in the surrounding environment.

In addition, although, in the foregoing embodiments, the coefficient of correction fi is determined by measuring the ambient conditions, including the ambient temperature and relative humidity, or vapor pressure, or absolute humidity, for each predetermined time $t_0$, the present invention is not limited to the same. In the actual operation of the photosensitive material processor such as the automatic processor 10, there are cases where the power supply is turned off during the night, in which case the CPU 82 of the controller 78 is also stopped. By assuming such an operation, the amount of water to be added in correspondence with the amount of evaporation during the night (resting condition) may be calculated on the basis of the ambient conditions in the standby and drive conditions.

For instance, in a water adding method in which the amount of water to be added is calculated in correspondence with the ambient conditions as in the first and second embodiments, in a case where the power supply is turned off during the night, the amount of water to be added can be calculated in the following manner. Namely, when the power supply is turned off during the night, the data such as the ambient conditions, various parameters, standby time TS, and drive time TD which are measured during the daytime and stored in the RAM 84 are backed up by a backup power supply such as a battery. At the same time, a timer is operated by this backup power supply to count the resting time T0.

Although the temperature and the relative humidity change during the daytime and the nighttime, those conditions affecting the amount of evaporation, such as the vapor pressure P and the absolute humidity H, undergo small changes. For instance, on a day when the humidity condition during the daytime was the high-humidity condition (coefficient of correction=f2), the humidity condition during the nighttime remains the high-humidity condition in most cases.

For this reason, when the power supply is turned on on the following morning, water can be added by determining the coefficient of correction fi from the averages of the ambient conditions during the daytime (such as temperature and relative humidity, vapor pressure, and absolute humidity) and by calculating the amount of water to be added in correspondence with the amount of evaporation during the nighttime (resting condition) on the basis of the coefficient of correction fi and the counted resting time T0. In addition, in a case where the value of the coefficient of correction fi is changed by small degrees in correspondence with the ambient conditions, because the ambient conditions change slightly during the nighttime, there are cases where the coefficient of correction fi determined only by the ambient conditions measured during the day time with the power supply turned off during the nighttime becomes a value slightly different from the coefficient of correction fi determined by measuring the ambient conditions during the nighttime by operating the CPU 82 during the nighttime as well, resulting in different amounts of water to be added. In such a case, an arrangement may be provided such that the difference in the amount of water to be added is determined in advance through experiments and the like, and the value of the evaporation speed V0 during resting is adjusted so as to correct that difference. Thus, the nighttime ambient conditions need not necessarily be measured, and the amount of water to be added in correspondence with the amount of nighttime evaporation can be determined from the average values of the ambient conditions in the standby and drive conditions.

In addition, in the water adding method in which the amount of water to be added is calculated by taking into consideration the temperature of the processing solution in addition to the ambient conditions as in the third and fourth embodiments, in a case where the apparatus is used with the power supply turned off during the night, the nighttime temperature of the processing solution differs substantially from the daytime temperature thereof since the heater is turned off during the night. Therefore, if the amount of water to be added in correspondence with the amount of nighttime evaporation is calculated by using the coefficient of correction fi calculated on the basis of the nighttime ambient conditions and solution temperature, the error becomes large, so that it is not desirable. For this reason, the amount of water to be added may be calculated by determining the coefficient of correction fi for calculating an amount of water to be added in correspondence with the amount of nighttime evaporation on the basis of, for instance, average values of the ambient conditions and the solution temperature persisting immediately before the turning off of the power supply and the ambient conditions and the solution temperature persisting when the power supply is turned on the next morning, and by separately calculating the amount of water to be added in correspondence with the amount of the previous day's daytime evaporation and the amount of water to be added in correspondence with the amount of the nighttime evaporation and by subsequently totalizing the two amounts.

What is claimed is:

1. A method of adding water to a photosensitive material processor for adding an amount of water corresponding to an amount of evaporation of a processing solution stored in a processing tank of the photosensitive material processor, to the processing tank, comprising the steps of:

(a) determining in advance relationships between an ambient condition which is determined by a measured ambient vapor pressure at a location of the photosensitive material processor, and the amount of evaporation of the processing solution;

(b) detecting the ambient condition; and (c) determining the amount of water to be added to said processing tank on the basis of the ambient condition detected and the relationships.

2. A method of adding water to a photosensitive material processor according to claim 1, wherein the relationships between the ambient condition and the amount of evaporation of the processing solution are set in correspondence with operating conditions of said photosensitive material processor including a standby condition, a drive condition, and a resting condition, and wherein, in step (c), the amount of water to be added to said processing tank is determined by adding amounts of water to be added in the operating conditions.

3. A method of adding water to a photosensitive material processor according to claim 1, wherein a plurality of processing tanks are provided, and wherein, in step (a), the relationships between the ambient condition and the amount of evaporation of the processing solution are determined in advance for each of said processing tanks and, in step (c), the amount of water to be added to each of said processing tanks is determined on the basis of the ambient condition detected and the relationships.

4. A method of adding water to a photosensitive material processor according to claim 1, wherein the ambient vapor pressure is determined from an ambient temperature and the ambient relative humidity at a location of said photosensitive material processor.

5. A method of adding water to a photosensitive material processor according to claim 1, wherein the ambient vapor pressure is determined from an ambient dew point of said photosensitive material processor.

6. A method of adding water to a photosensitive material processor according to claim 1, wherein said ambient condition includes a standard condition, a low-humidity condition, and a high-humidity condition, and the amount of evaporation of the processing solution is set for each of the standard condition, the low-humidity condition, and the high-humidity condition.

7. A method of adding water to a photosensitive material processor according to claim 1, wherein, in step (c), the amount of water to be added to said processing tank is determined for each predetermined time on the basis of the ambient condition detected and the relationships, and the amount of water to be added to said processing tank is determined by totalizing the amounts of water to be added determined until a water adding timing is reached.

8. A method of adding water to a photosensitive material processor for adding an amount of water corresponding to an amount of evaporation of a processing solution stored in a processing tank of the photosensitive material processor, to the processing tank, comprising the steps of:

(a) determining in advance relationships among: an ambient conditions which is determined by one of 1) an ambient temperature and an ambient relative humidity at a location of said photosensitive material processor, 2) an ambient vapor pressure, and 3) an ambient absolute humidity; a temperature of the processing solution; and the amount of evaporation of the processing solution;

(b) detecting the ambient condition and the temperature of the processing solution; and (c) determining the amount of water to be added to said processing tank on the basis of the ambient condition and the temperature of the processing solution detected and the relationships.

9. A method of adding water to a photosensitive material processor according to claim 8, wherein the relationships among the ambient condition, the temperature of the processing solution, and the amount of evaporation of the processing solution are set in correspondence with operating conditions of said photosensitive material processor including a standby condition, a drive condition, and a resting condition, and wherein, in step (c), the amount of water to be added to said processing tank is determined by adding amounts of water to be added in the operating conditions.

10. A method of adding water to a photosensitive material processor according to claim 8, wherein a plurality of processing tanks are provided, and wherein, in step (a), the relationships among the ambient condition, the temperature of the processing solution, and the amount of evaporation of the processing solution are determined in advance for each of said processing tanks and, in step (c), the amount of water to be added to each of said processing tanks is determined on the basis of the ambient condition and the temperature of the processing solution detected and the relationships.

11. A method of adding water to a photosensitive material processor according to claim 8, wherein said ambient condition includes a standard condition, a low-humidity condition, and a high-humidity condition, and the amount of evaporation of the processing solution is set for the temperature of the processing solution and each of the standard condition, the low-humidity condition, and the high-humidity condition.

12. A method of adding water to a photosensitive material processor according to claim 8, wherein, in step (c), the amount of water to be added to said processing tank is determined for each predetermined time on the basis of the ambient condition detected, the temperature of the processing solution detected, and the relationships, and the amount of water to be added to said processing tank is determined by totalizing the amounts of water to be added determined until a water adding timing has arrived.

13. A method of adding water to a photosensitive material processor according to claim 8, wherein, in step (a), relationships between the ambient condition and the amount of evaporation of the processing solution are determined in advance on the basis of one of a difference between the ambient vapor pressure and a saturated vapor pressure of the processing solution determined by the temperature of the processing solution and a difference between the ambient absolute humidity and an absolute humidity of the processing solution determined by the temperature of the processing solution.

14. An apparatus for adding water to a photosensitive material processor for adding an amount of water corresponding to an amount of evaporation of a processing solution stored in a processing tank of the photosensitive material processor, to the processing tank, said apparatus comprising:

detecting means for detecting an ambient condition which is determined by an ambient vapor pressure at a location of said photosensitive material processor;

determining means for determining an operating condition of said photosensitive material processor;

detecting means for detecting a duration of the operating condition determined by said determining means;

storage means for storing an evaporation speed corresponding to the operating condition of said photosensitive material processor and a coefficient of correction corresponding to the ambient condition;

calculating means for calculating the amount of water to be added on the basis of the ambient condition detected, the duration detected, and a result of determination by said determining means, and the evaporation speed and the coefficient of correction stored in said storage means; and supplying means for supplying water to said processing tank on the basis of the amount of water to be added.

15. An apparatus for adding water to a photosensitive material processor according to claim 14, wherein the operating condition includes a standby condition, a drive condition, and a resting condition, while the evaporation speed corresponding to the operating condition includes the evaporation speed at a time of the standby condition, the evaporation speed at a time of the drive condition, and the evaporation speed at a time of the resting condition.

16. An apparatus for adding water to a photosensitive material processor according to claim 14, wherein the coefficient of correction corresponding to the ambient condition includes the coefficient of correction under a low-humidity condition for correcting so as to increase the amount of water to be added which is determined in correspondence with the evaporation speed and the coefficient of correction under a high-humidity condition for correcting so as to decrease the amount of water to be added which is determined in correspondence with the evaporation speed.

17. An apparatus for adding water to a photosensitive material processor according to claim 14, wherein said calculating means calculates the amount of water to be added by totalizing amounts of water to be added which are based on a product of the coefficient of correction corresponding to the ambient condition detected for each predetermined time, the evaporation speed corresponding to the operating condition, and the duration of the operating condition, said totalization being continued until a water adding timing is reached.

18. A method of adding an amount of water corresponding to an amount of evaporation of a processing solution stored in a processing tank of a photosensitive material processor, comprising the steps of:

(a) determining in advance relationships between an ambient condition, which is determined by a detected ambient absolute humidity at a location of said photosensitive material processor, and the amount of evaporation of the processing solution;

(b) detecting the ambient condition; and (c) determining the amount of water to be added to said processing tank on the basis of the detected ambient condition and said relationships.

19. A method of adding water to a photosensitive material processor according to claim 18, wherein the ambient absolute humidity is used to determine an ambient vapor pressure for obtaining the ambient condition.

20. A method of adding an amount of water corresponding to an amount of evaporation of a processing solution stored in a processing tank of a photosensitive material processor, comprising the steps of:

(a) determining in advance relationships between an ambient condition, which is determined by a measured ambient dew point at a location of the photosensitive material processor, and the amount of evaporation of the processing solution;

(b) detecting the ambient condition; and (c) determining the amount of water to be added to said processing tank on the basis of the detected ambient condition and said relationships.

21. A method of adding water to a photosensitive material processor according to claim 20, wherein the ambient dew point of said photosensitive material processor is used to determine an ambient vapor pressure for obtaining the ambient condition.

22. An apparatus for adding an amount of water corresponding to an amount of evaporation of a processing solution stored in a processing tank of a photosensitive material processor, said apparatus comprising:

detecting means for detecting an ambient condition which is determined by an ambient absolute humidity at a location of said photosensitive material processor;

determining means for determining an operating condition of said photosensitive material processor;

detecting means for detecting a duration of the operating condition determined by said determining means;

storage means for storing an evaporation speed corresponding to the operating condition of said photosensitive material processor and a coefficient of correction corresponding to the ambient condition;

calculating means for calculating the amount of water to be added on the basis of the ambient condition detected, the duration detected, and a result of determination by said determining means, and the evaporation speed and the coefficient of correction stored in said storage means; and supplying means for supplying water to said processing tank on the basis of the calculated amount of water to be added.

23. An apparatus for adding an amount of water corresponding to an amount of evaporation of a processing solution stored in a processing tank of a photosensitive material processor, said apparatus comprising:

detecting means for detecting an ambient condition which is determined by a dew point at a location of said photosensitive material processor;

determining means for determining an operating condition of said photosensitive material processor;

detecting means for detecting a duration of the operating condition determined by said determining means;

storage means for storing an evaporation speed corresponding to the operating condition of said photosensitive material processor and a coefficient of correction corresponding to the ambient condition;

calculating means for calculating the amount of water to be added on the basis of the ambient condition detected, the duration detected, and a result of determination by said determining means, and the evaporation speed and the coefficient of correction stored in said storage means; and supplying means for supplying water to said processing tank on the basis of the calculated amount of water to be added.

* * * * *